US007360344B2

(12) United States Patent
White et al.

(10) Patent No.: US 7,360,344 B2
(45) Date of Patent: Apr. 22, 2008

(54) METHOD AND APPARATUS FOR SLEEVE OR BAND-TYPE PACKAGING OF A COMPRESSIBLE ARTICLE

(75) Inventors: Barton J. White, Freedom, WI (US); Andrew L. Haasl, Green Bay, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 0 days.

(21) Appl. No.: 11/228,836

(22) Filed: Sep. 16, 2005

(65) Prior Publication Data

US 2006/0059864 A1 Mar. 23, 2006

Related U.S. Application Data

(60) Provisional application No. 60/611,060, filed on Sep. 17, 2004.

(51) Int. Cl.
*B65B 63/02* (2006.01)
*B65B 43/08* (2006.01)

(52) U.S. Cl. ..... 53/399; 53/438; 53/459; 53/529; 53/563; 53/567; 53/585

(58) Field of Classification Search ..... 53/438, 53/529, 563, 459, 399, 585, 567, 574, 575, 53/570, 255

See application file for complete search history.

(56) References Cited

U.S. PATENT DOCUMENTS 2,737,000 A * 3/1956 McCargar ..... 53/511
3,343,334 A 9/1967 Bode et al.
3,417,544 A 12/1968 Grevich
3,445,983 A 5/1969 Stevens
3,513,628 A 5/1970 Lee et al.
3,662,514 A * 5/1972 Goss ..... 53/469
3,710,536 A 1/1973 Lee et al.
3,729,886 A 5/1973 Lucas et al.
3,775,930 A 12/1973 Mercer et al.
3,792,564 A * 2/1974 Brady, Jr. ..... 53/530
3,811,242 A * 5/1974 Hayford et al. ..... 53/399
3,830,037 A * 8/1974 Purdom et al. ..... 53/529
3,848,398 A 11/1974 Suhr
3,928,941 A 12/1975 Singer
4,110,954 A 9/1978 Olsson et al.

(Continued)

FOREIGN PATENT DOCUMENTS

JP 04327123 A * 11/1992

*Primary Examiner*—Stephen F. Gerrity
(74) *Attorney, Agent, or Firm*—Boyle Fredrickson SC

(57) ABSTRACT

A packaging system for packaging a compressible article, such as a stack of interfolded paper towels, includes a sleeve supply arrangement for supplying a packaging sleeve to a loading area, a reciprocating article supply arrangement for selectively positioning a compressed article in the loading area, and a sleeve advancing arrangement for advancing the formed sleeve onto the compressed article at the loading area. After a sleeve is advanced onto the compressed article, the article supply arrangement is moved away from the loading area. A movable stripper engages the article and the sleeve during movement away from the loading area, to strip the article and the sleeve from the article supply arrangement. As the article and the sleeve are removed from the article supply arrangement, the article undergoes decompression and establishes contact with the sleeve to maintain the article and the sleeve in frictional engagement, to form a pack.

22 Claims, 23 Drawing Sheets

U.S. PATENT DOCUMENTS 4,162,600 A * 7/1979 Westall et al. ..... 53/585
4,241,562 A * 12/1980 Meyer ..... 53/438
4,242,854 A 1/1981 Nissen
4,328,655 A 5/1982 Spencer et al.
4,408,438 A 10/1983 Rewitzer
4,592,193 A 6/1986 Gustavsson
4,738,078 A 4/1988 Benz et al.
4,845,924 A 7/1989 Focke et al.
4,858,416 A 8/1989 Monaghan
5,022,216 A 6/1991 Muckenfuhs et al.
5,150,561 A * 9/1992 Muckenfuhs ..... 53/412
5,189,864 A 3/1993 Cinotti et al.
5,195,300 A 3/1993 Kovacs et al.
5,249,408 A 10/1993 Winnemoller et al.
5,367,858 A 11/1994 Haasl
5,459,979 A 10/1995 Tommasi
5,701,723 A * 12/1997 Simpson ..... 53/435
5,979,145 A 11/1999 Louis et al.
6,058,684 A 5/2000 Suokas
6,223,500 B1 5/2001 Kramps
2002/0073655 A1 6/2002 Gamberini
2003/0024211 A1 2/2003 Kackenmeister et al.

* cited by examiner

METHOD AND APPARATUS FOR SLEEVE OR BAND-TYPE PACKAGING OF A COMPRESSIBLE ARTICLE

CROSS-REFERENCE TO RELATED APPLICATION

This application claims the benefit of U.S. Provisional Application Ser. No. 60/611,060, filed Sep. 17, 2004.

BACKGROUND AND SUMMARY

This invention relates to an apparatus and method for packaging a compressible article such as a stack of interfolded paper towels or the like.

There are a number of prior art sleeve or band-type packaging systems for packaging compressible articles, such as stacks of interfolded paper towels. In one arrangement, as shown and described in Lucas et al U.S. Pat. No. 3,729,886 (hereby incorporated by reference), the articles are compressed by opposed belts as the articles travel toward a wrapping area. A sheet is applied to one surface of the compressed stack, and is wrapped about the stack and glued together to form a band or sleeve about the compressed stack. Compression is maintained on the stack and the formed band or sleeve until the adhesive has set sufficiently to maintain the bond between the sheets when compression on the pack is released. A modification of this system involves applying a pair of sheets to the compressed stack, which are severed from a pair of webs supplied from a pair of parent rolls. The sheets are formed about the stack so that the edges of the sheets overlap, and the overlapped edges are glued together while maintaining compression on the stack. A banding or sleeving system of this type is available from the Green Bay Engineering division of Fabio Perini North America of Green Bay, Wis. under its designation Model 120. In another arrangement, which is shown and described in Haasl U.S. Pat. No. 5,367,858 (hereby incorporated by reference), a series of pairs of prongs are mounted to a pivoting turret mechanism. The prongs are moved to a collapsed position, where a partially opened sleeve is positioned over the collapsed prongs. The prongs are mounted to a turret mechanism, which pivots the prongs to an inserting station at which a compressed stack of articles is inserted into the opened sleeve. The prongs are pivoted to a removal station, at which a removing mechanism removes the stack and the sleeve from between the prongs. The stack undergoes decompression as it emerges from between the prongs, to expand into engagement with the sleeve. Several sets of prongs are mounted to the turret mechanism, which provides continuous indexing movement of the prongs between the sleeving, inserting and removal stations of the system. A banding or sleeving system of this type is available from the Green Bay Engineering division of Fabio Perini North America of Green Bay, Wis. under its designation Model 90.

The above-described banding or sleeving systems functions well and have proven to be a reliable and relatively efficient means for banding or sleeving a pack. However, each system has certain limitations. In the case of the first of the above-noted arrangements, two webs of material are supplied and wrapped about the stack, which involves support and drive components for two parent rolls of material. In addition, in order to maintain compression on the pack to allow the adhesive to set, the pack is advanced between a pair of discharge belts, which requires two sets of belt drive components. In addition, in order to operate at high speeds, a certain amount of machine length is required in order to enable the adhesive to set sufficiently prior to discharge. In the case of the second of the above-noted arrangements, the turret mechanism adds a certain amount of complexity and limits the rate at which the packs can be formed.

It is an object of the present invention to provide a band or sleeve-type packaging system for a compressible article or article, such as a stack of interfolded paper towels, which provides simplified operation and movement of the stack and the packaging material for applying the packaging material about the compressed stack. It is another object of the invention to provide such a packaging system which forms the band or sleeve from a single web of packaging material, thus eliminating the need for two separate sets of web support and drive components. It is another object of the invention to provide such a packaging system in which the band or sleeve is advanced onto the compressed stack while compression is maintained on the stack, which avoids forming the webs about the compressed stack and the necessary machine components and length required in the prior art to enable the bonded webs to set prior to discharge of the pack. Yet another object of the invention is to provide such a packaging system which is capable of operating at relatively high speeds.

In accordance with the present invention, a packaging system for packaging a compressible article, such as a stack of interfolded paper towels, includes a sleeve supply arrangement for supplying a sleeve of packaging material to a location adjacent a loading area, an article supply arrangement for positioning a compressed article in the loading area, and a sleeve advancing arrangement for advancing the formed sleeve onto the compressed article at the loading area. The article supply arrangement is movable toward and away from the loading area. After a sleeve is advanced onto the compressed article at the loading area, the article supply arrangement is moved away from the loading area. A movable stripping arrangement engages the article and the sleeve as the article supply arrangement is moved away from the loading area, to strip the article and the sleeve from the article supply arrangement. As the article and the sleeve are removed from the article supply arrangement in this manner, the article undergoes decompression, which results in the article establishing contact with interior surfaces of the sleeve so as to maintain the article and the sleeve in frictional engagement to form a pack.

The sleeve forming arrangement is operable to form a collapsed continuous tube from a web of packaging material, such as paper, with the edge areas of the web being formed in an overlapping relationship. A bonding agent, such as glue, is applied between the overlapping edge areas of the web to form the collapsed tube. The tube is advanced onto a sleeve former, which functions to erect the sleeve as the sleeve is advanced to a location adjacent the loading area. After the collapsed tube is formed, the collapsed tube passes through a perforating assembly that forms transverse perforations at predetermined intervals along the length of the collapsed tube. When the sleeve is advanced from the former onto the compressed article at the loading area, advancement of the sleeve separates the sleeve from the next adjacent sleeve by breaking the perforations, and the next adjacent sleeve is then advanced onto the former for application to a subsequently supplied compressed article.

The former includes a downstream section that forms the sleeve to the desired erected configuration adjacent the loading area. The downstream section of the former is supported in a manner that enables the sleeve to be advanced onto the downstream section and subsequently off the downstream section for application to the compressed article. In a preferred embodiment, the downstream section of the former is supported using a magnetic support arrangement, which enables the sleeve to be advanced onto the downstream section of the former, and discharged from the downstream section of the former onto the compressed article.

The sleeve advancing arrangement may be in the form of spaced apart drive rollers that engage the sleeve so as to advance the sleeve in a downstream direction. The former preferably includes inner rollers, each of which forms a nip with one of the drive rollers, so that the drive rollers and the inner rollers cooperate to pinch the walls of the sleeve located between the drive roller and the inner roller to advance the sleeve onto the downstream section of the former. In one form, the magnetic support arrangement is in the form of magnets on the drive rollers and on the inner rollers that support the sleeve forming arrangement between the drive rollers. Additional pairs of inner and outer rollers may be provided for advancing the sleeve, and may include additional inner and outer magnets that support the downstream section of the former. The magnetic support arrangement may further include transversely oriented inner and outer axial positioning magnetic members that cooperate to maintain the downstream section of the former in a predetermined axial position.

The article supply arrangement may be in the form of a carriage that is movable between an article supply area and the loading area. The article supply arrangement includes at least one movable member that is operable to compress the article, and that maintains compression on the article as the sleeve is advanced onto the compressed article at the loading area. The article supply arrangement has relatively thin walls that maintain compression on the article at the loading area, and that are withdrawn from between the article and the interior surfaces of the sleeve as the article supply arrangement is moved away from the loading area.

The invention also contemplates a method of packaging a compressible article in a band or sleeve of packaging material, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
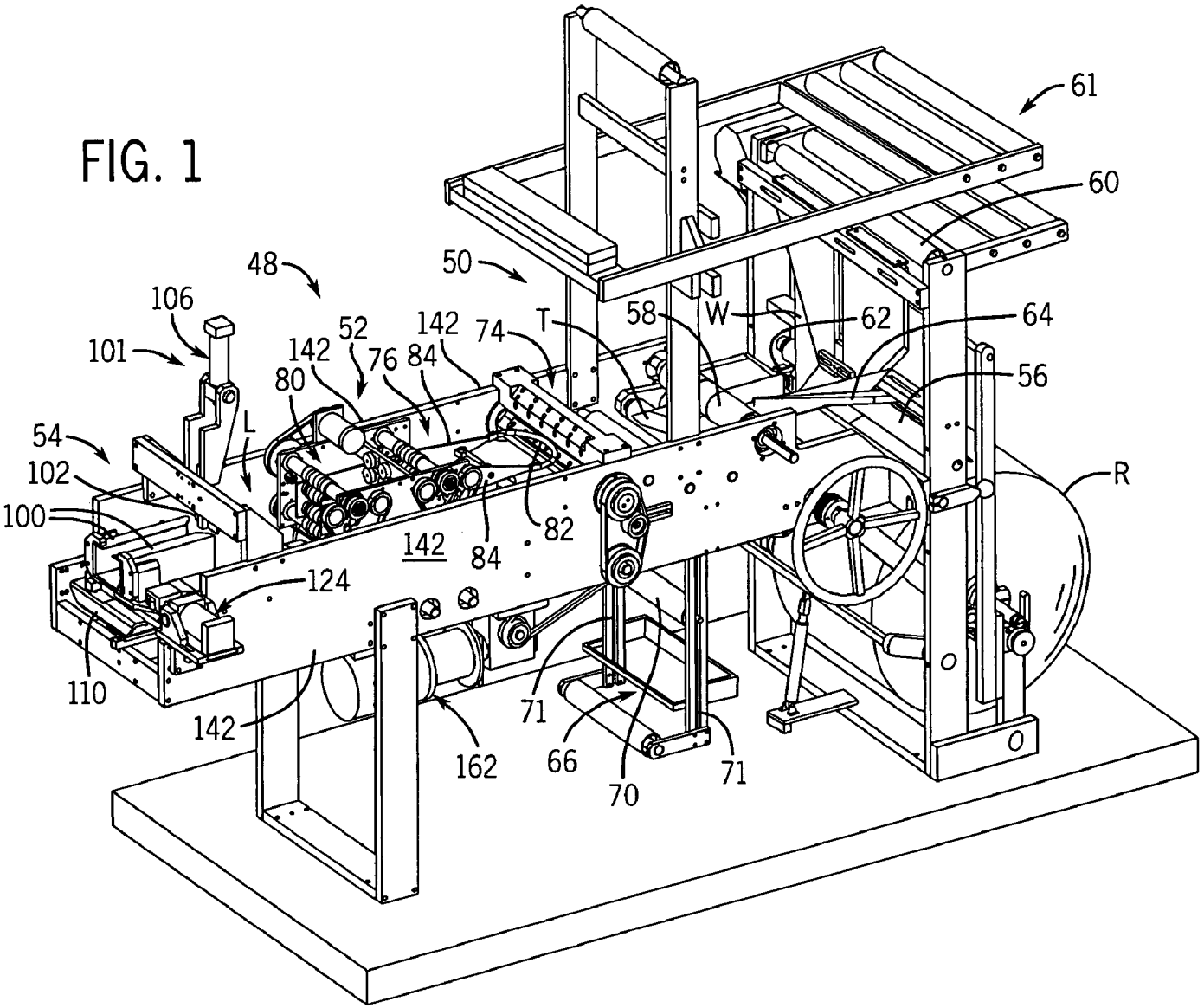
FIG. 1 is an isometric view of a packaging apparatus for packaging a compressible article in a sleeve or band of packaging material, in accordance with the present invention.
Figure 2:
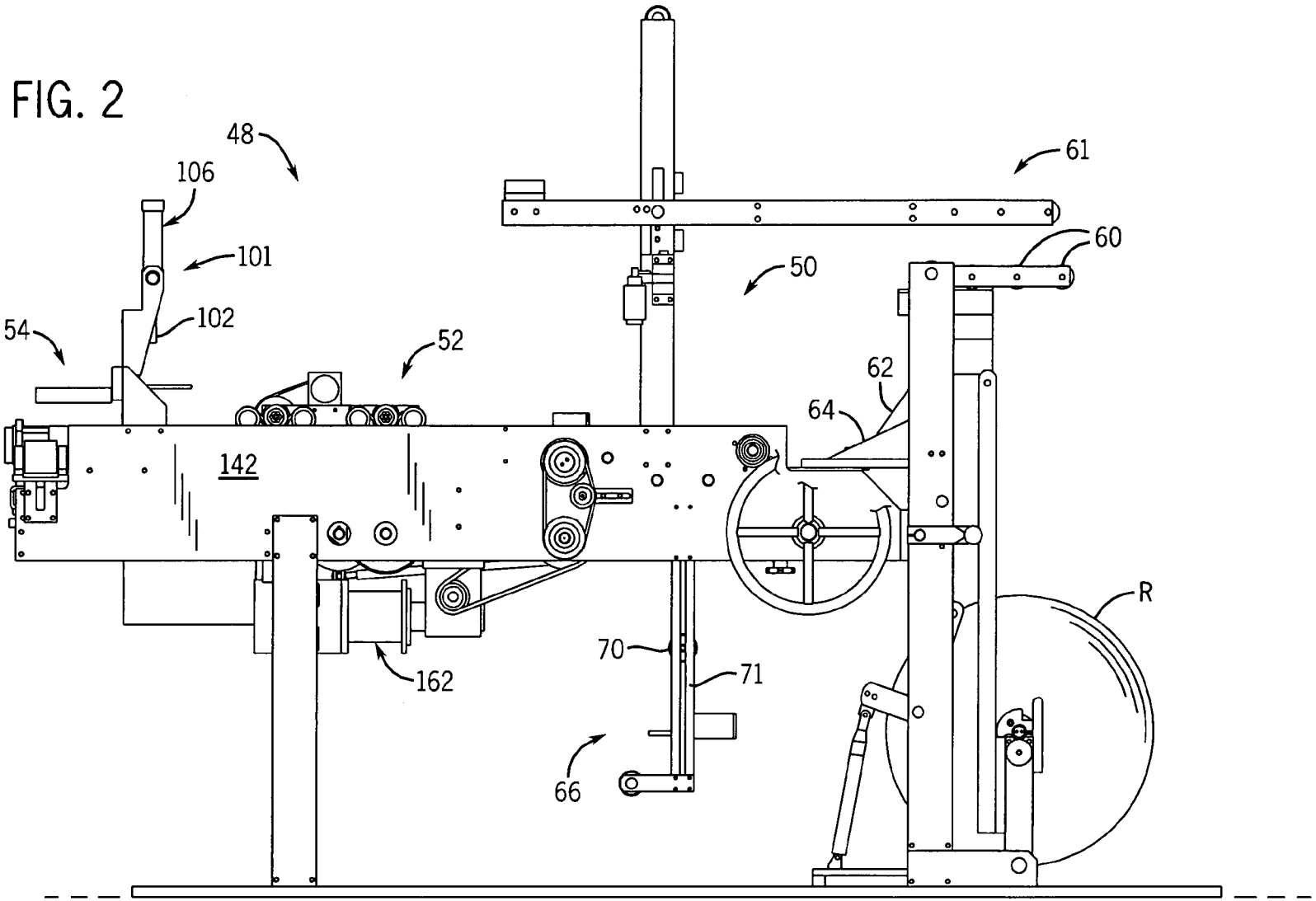
FIG. 2 is a side elevation view of the packaging apparatus of FIG. 1.
Figure 3:
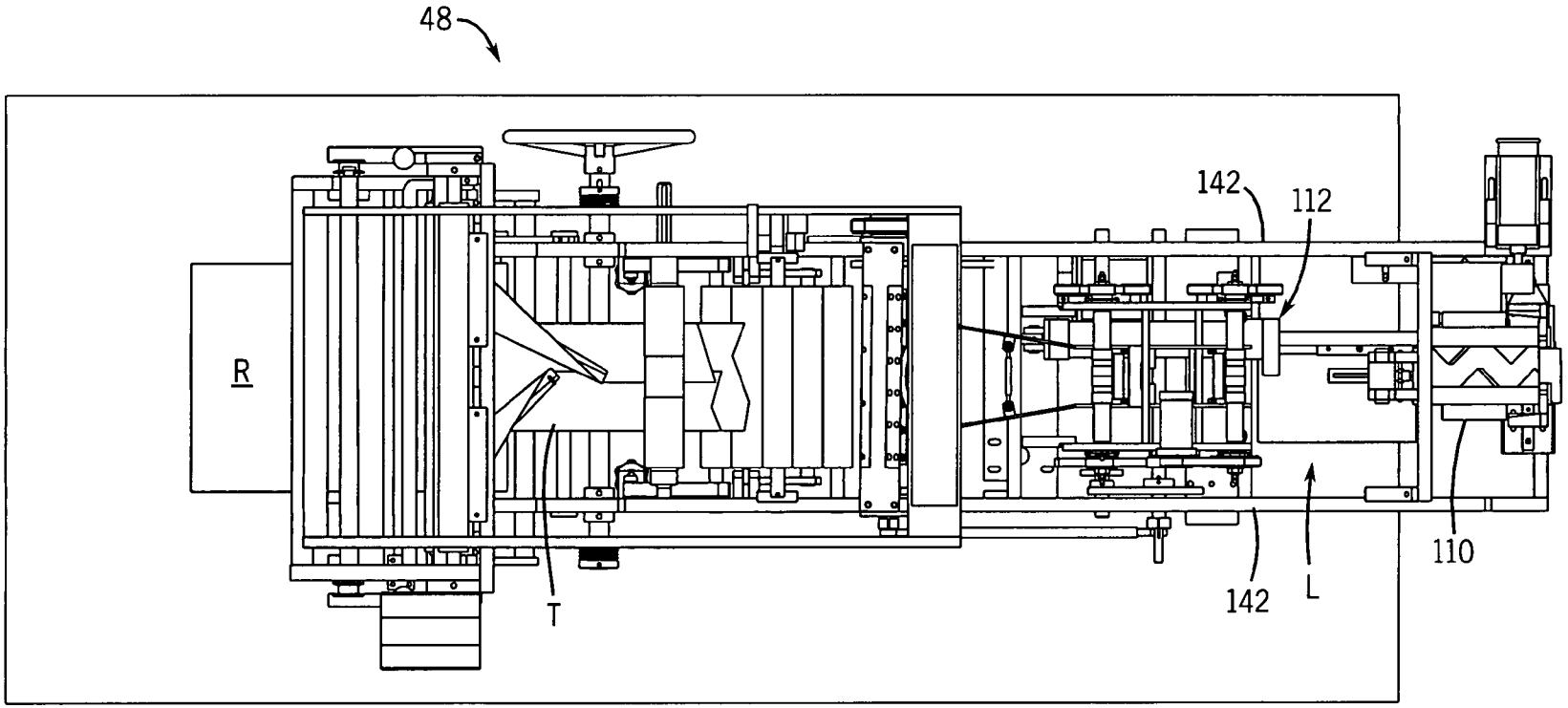
FIG. 3 is a top plan view of the packaging apparatus of FIG. 1.
Figure 4:
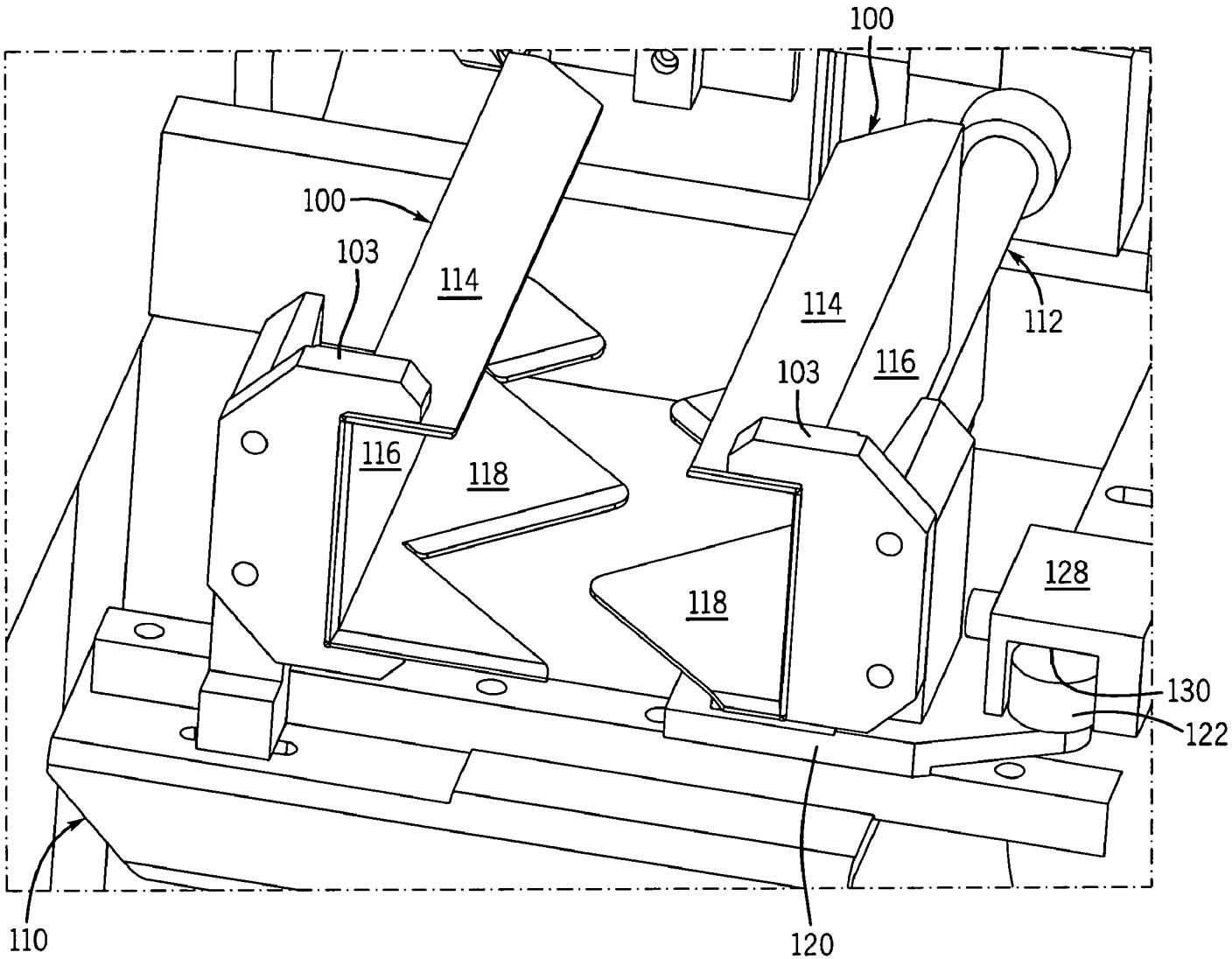
FIG. 4 is a partial isometric view illustrating an article supply arrangement incorporated in the packaging apparatus of FIG. 1, showing the article supply arrangement in an open position.
Figure 5:
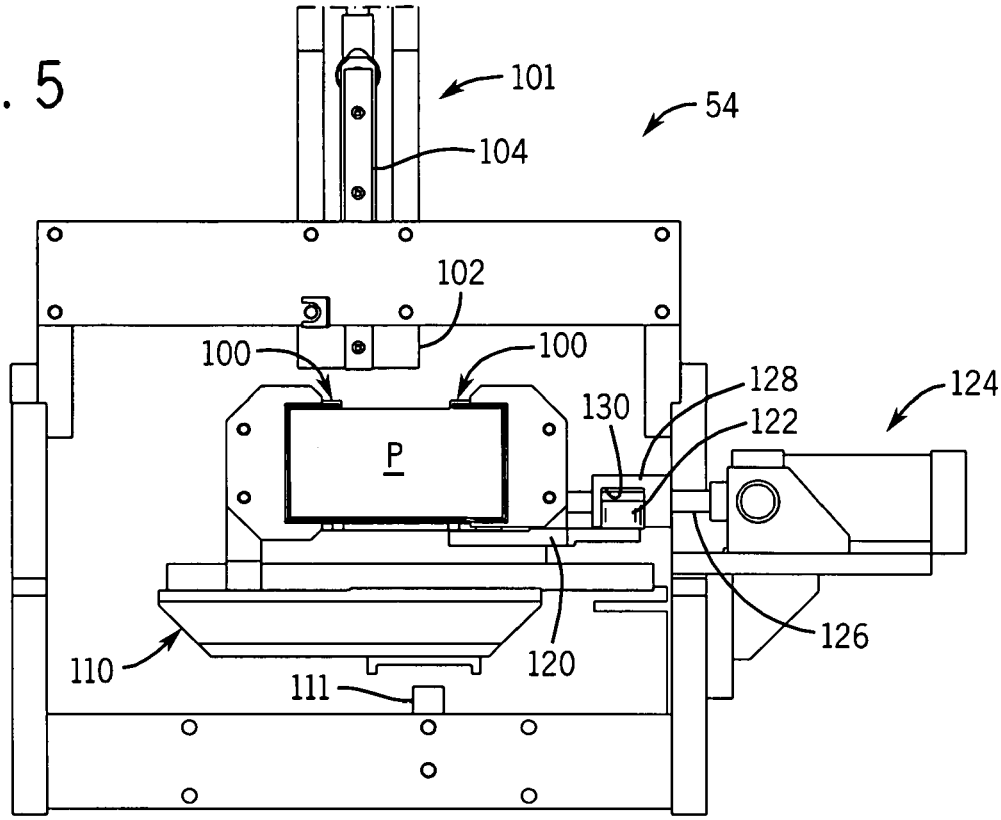
FIG. 5 is a partial end elevation view of the article supply arrangement of FIG. 4.
Figure 6:
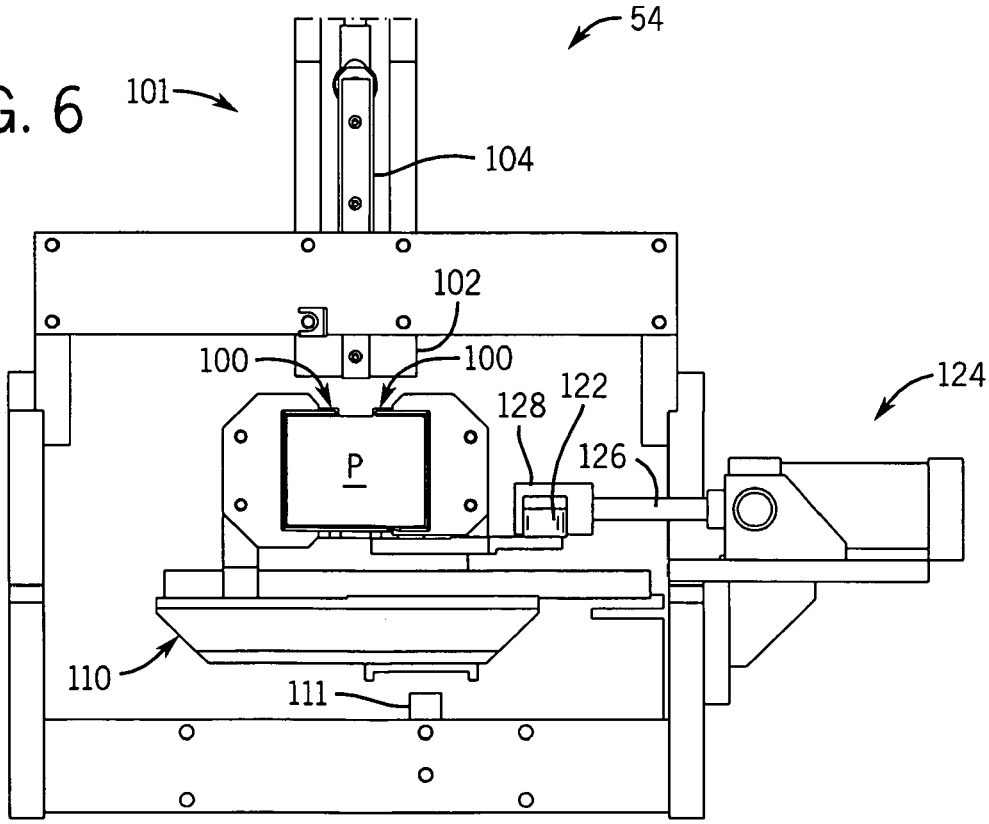
FIG. 6 is a view similar to FIG. 5, showing the article supply arrangement in a closed position for compressing the article.

Referring generally to FIGS. 1-3, the invention contemplates a packaging system 48 for applying a sleeve or band-type wrapper or package to a compressible article, such as a stack of interfolded paper towels. Generally, packaging apparatus 48 includes a sleeve supply arrangement in the form of a sleeve forming and supply section 50 that includes a loading mechanism 52, and an article supply arrangement or section 54.

Figure 16:
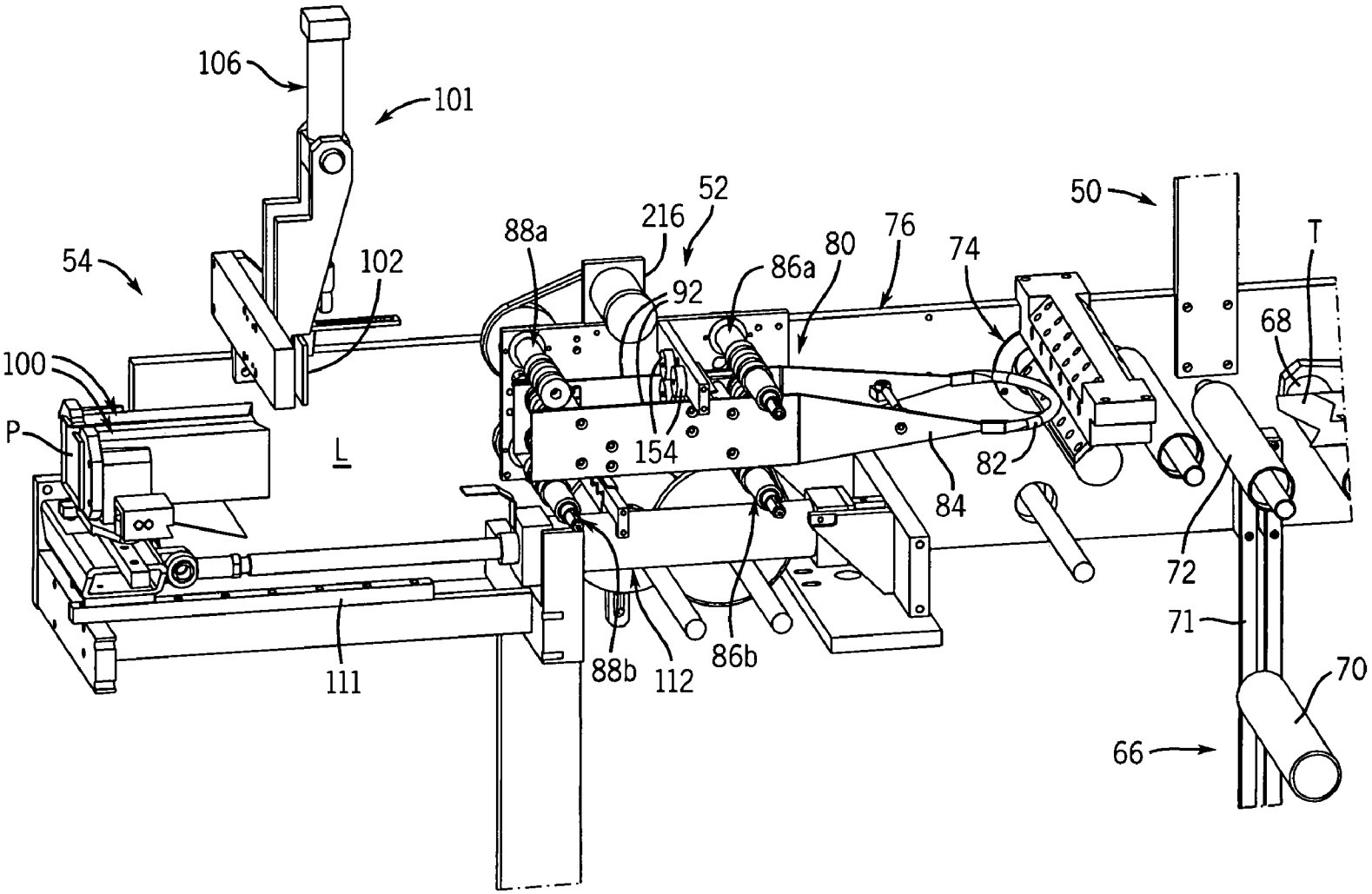
FIG. 16 is a partial isometric view of the sleeve supply arrangement and the article supply arrangement incorporated in the packaging apparatus of FIG. 1, illustrating a compressed article positioned in the article supply arrangement.
Figure 17:
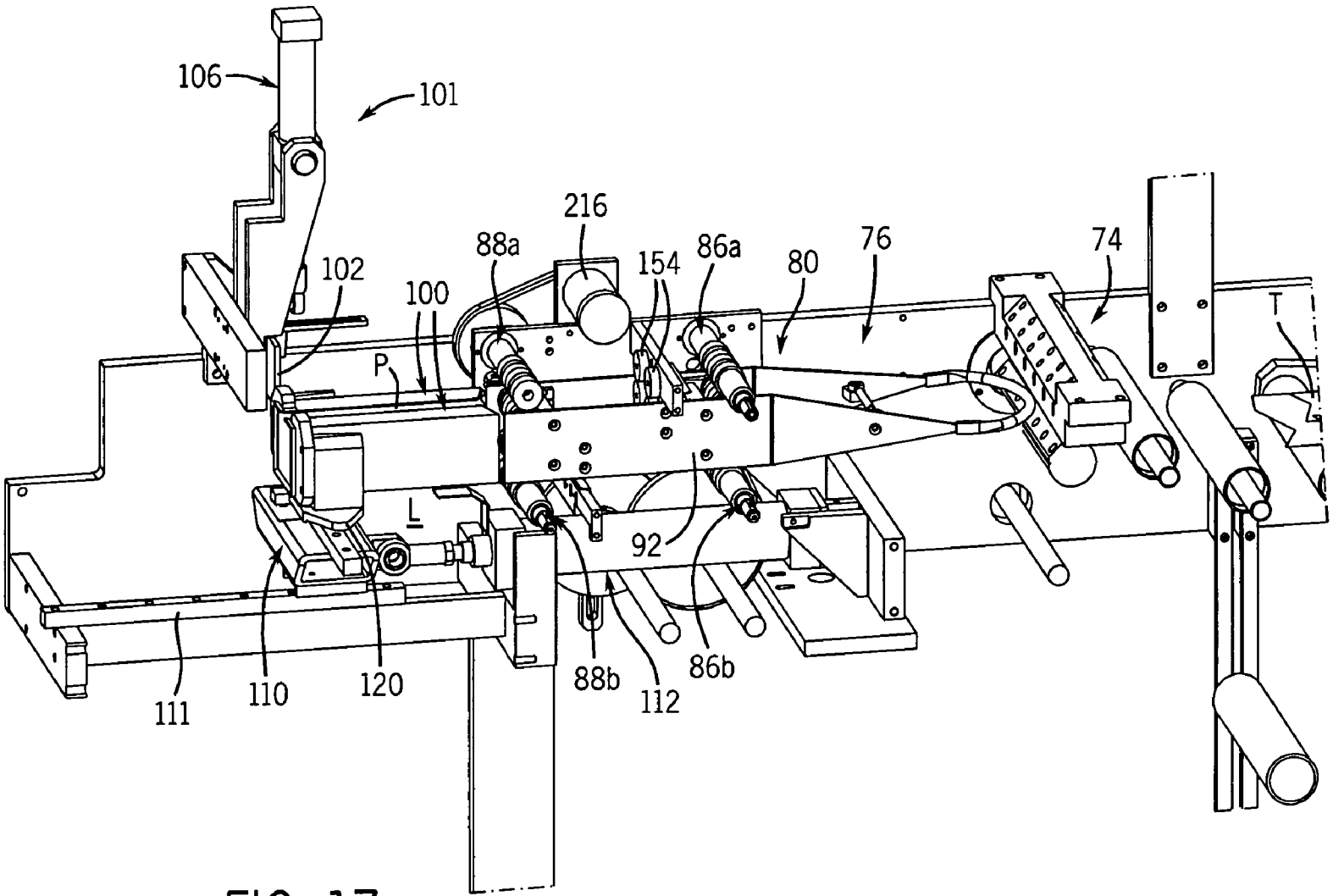
FIG. 17 is a view similar to FIG. 16, showing movement of the article supply arrangement to the loading area adjacent the sleeve supply arrangement.

Sleeve forming and supply section 50 supplies a web of packaging material, such as kraft paper or the like, from a supply roll R. The web from supply roll R is wrapped about an idler roll 56, and is unwound from roll R by operation of a pair of feed/pull rolls 58. Between roll R and feed/pull rolls 58, the web is wrapped about a series of upper idler rolls 60, as well as a counterbalanced upper dancer/festoon roll assembly 61 that is operable to maintain a desired amount of tension on the web. From dancer/festoon assembly 61, the web is supplied to a pair of forming bars 62, 64, which fold the web so as to form an overlapping C-fold. During the overlapping C-fold formation of the web, glue or any other satisfactory adhesive or bonding agent is introduced between the overlapping edge areas of the web, to create a glued tube T of sleeve or band-type wrap material. Feed/pull rolls 58 act on tube T to unwind the web from roll R, and to feed a continuous supply of tube T into a lower dancer/festoon assembly 66 that maintains a predetermined degree of tension on tube T. The dancer/festoon assembly 66 further includes an upper upstream idler roll 68 (FIG. 16), a lower dancer roll 70 that moves upwardly and downwardly within a pair of slotted supports 71, and an upper downstream idler roll 72. The festoon arrangement provided by idler rolls 68, 70 and 72 enables the glue between the edges of the web to set, in order to completely form tube T prior to tube T being supplied to loading mechanism 52.

Figure 18:
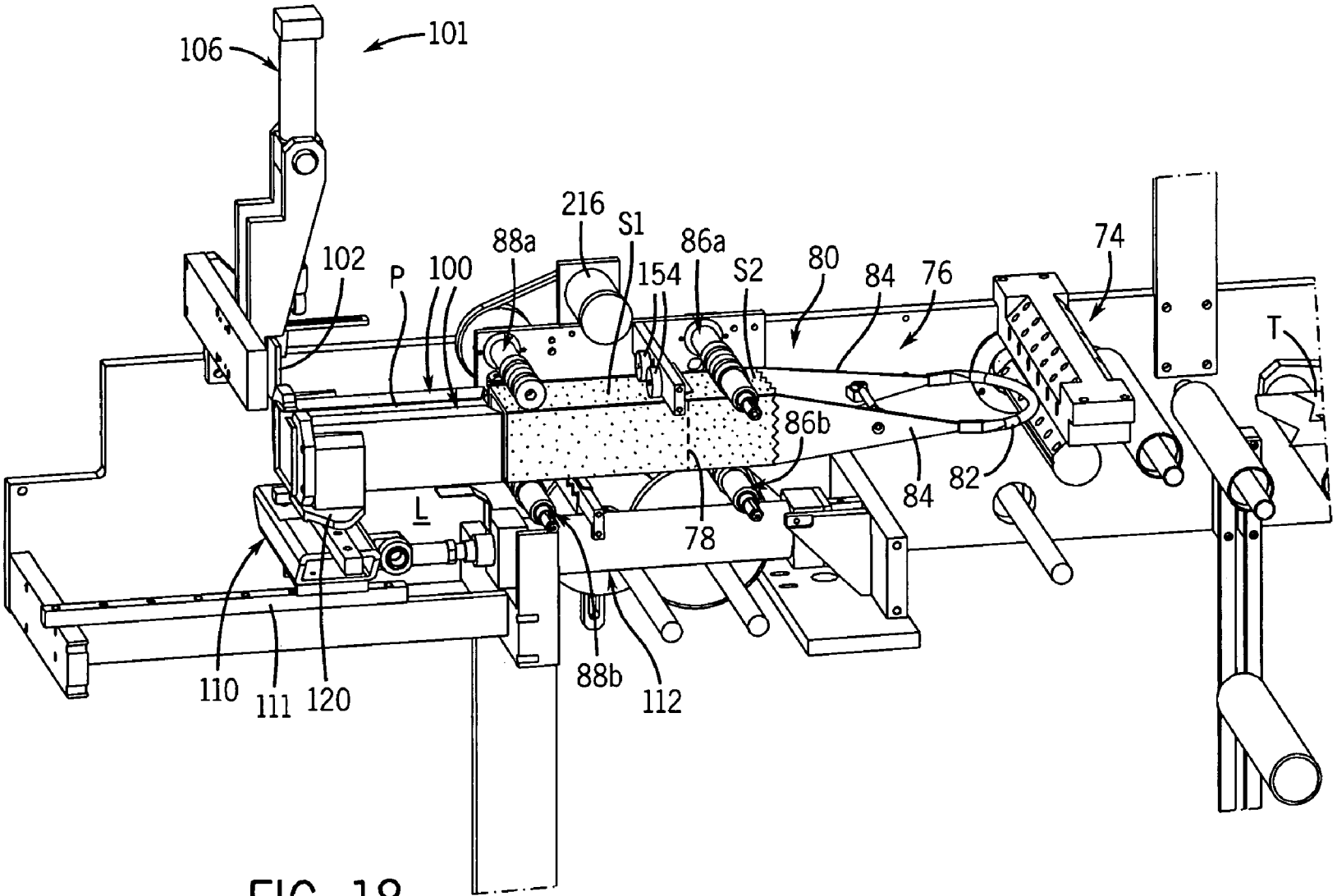
FIG. 18 is a view similar to FIG. 17, showing a sleeve positioned on the sleeve supply arrangement.
Figure 19:
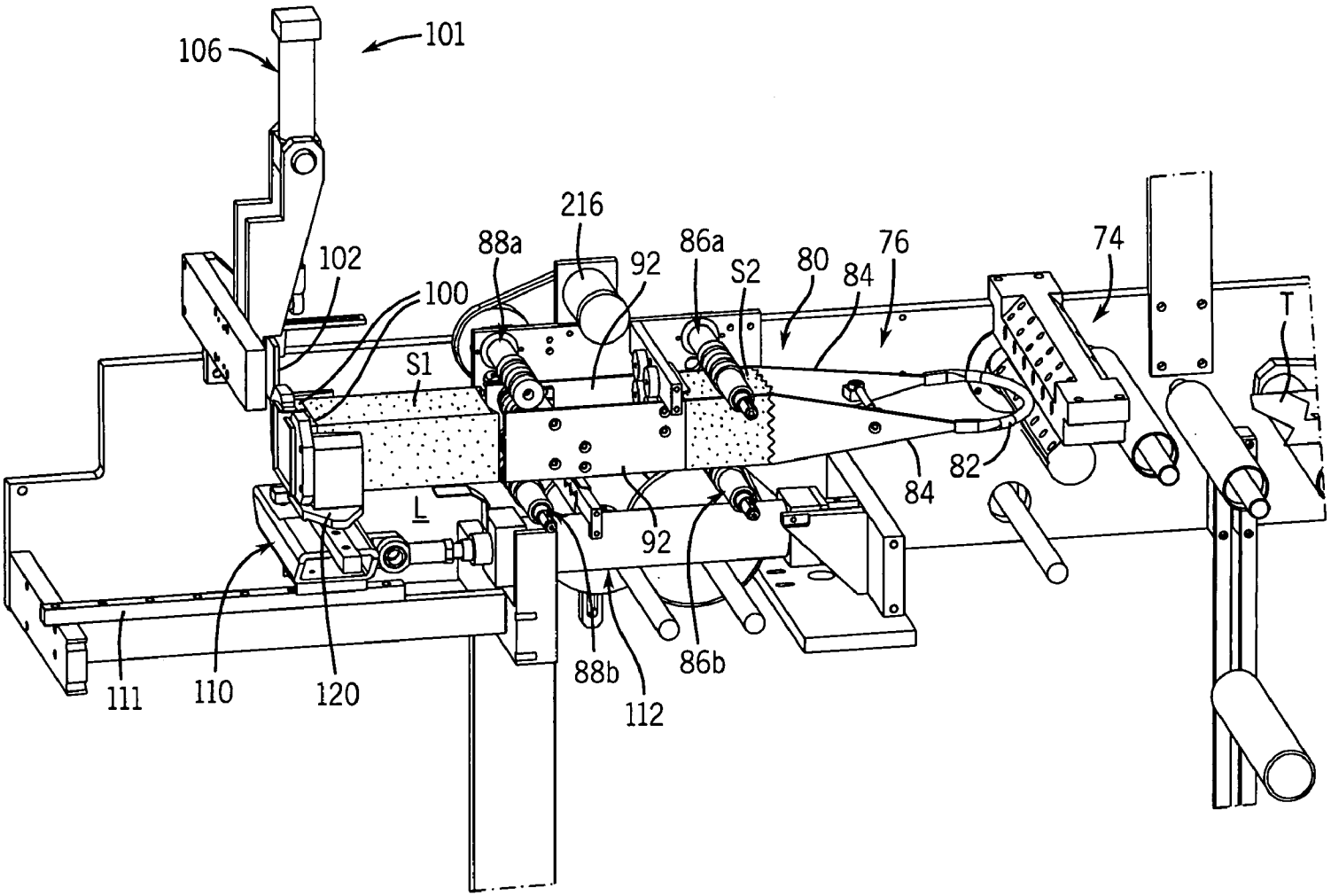
FIG. 19 is a view similar to FIG. 18, showing a sleeve advanced from the sleeve supply arrangement onto the article supply arrangement.
Figure 20:
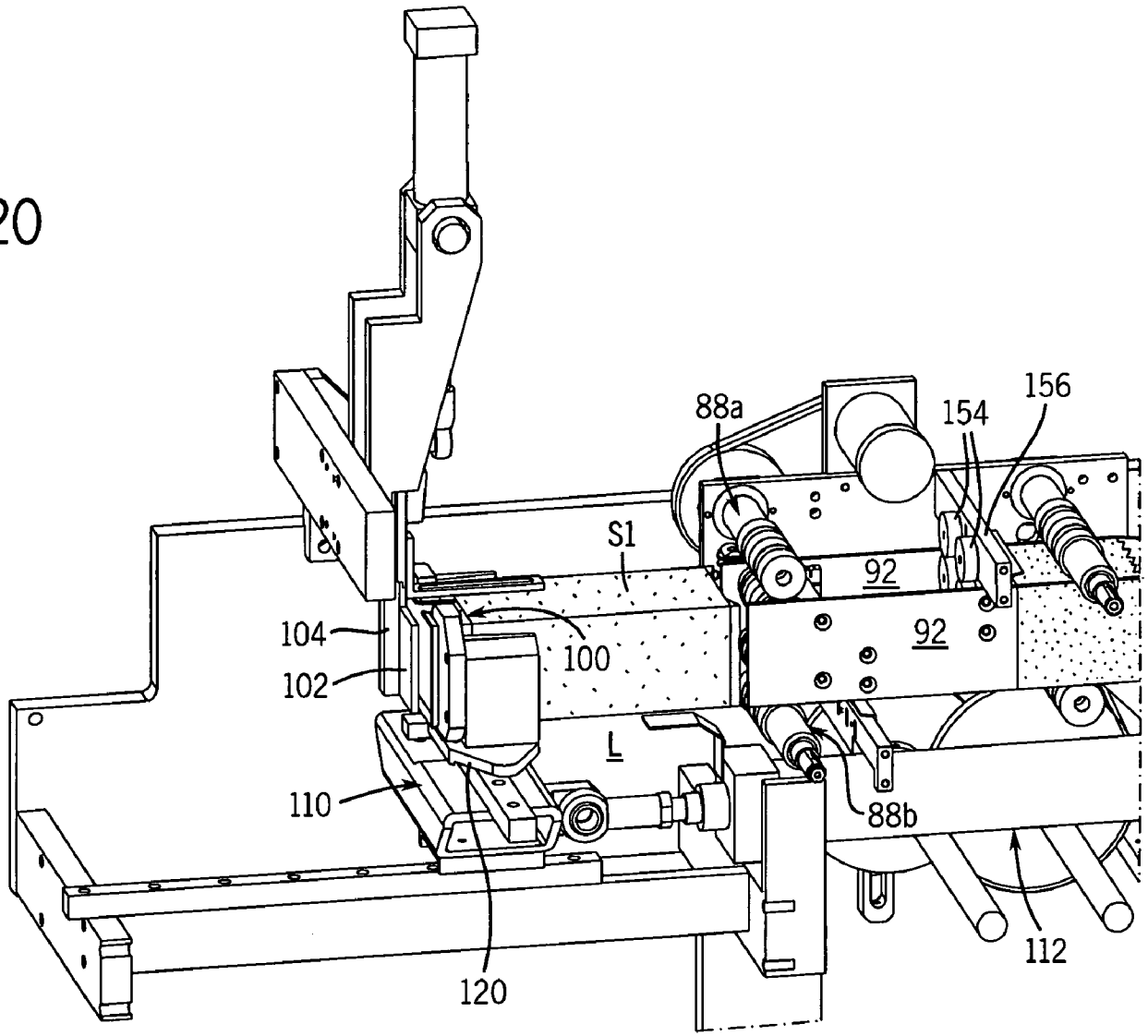
FIG. 20 is a view similar to FIG. 19, showing advancement of the sleeve onto the article supply arrangement at the loading area.
Figure 21:
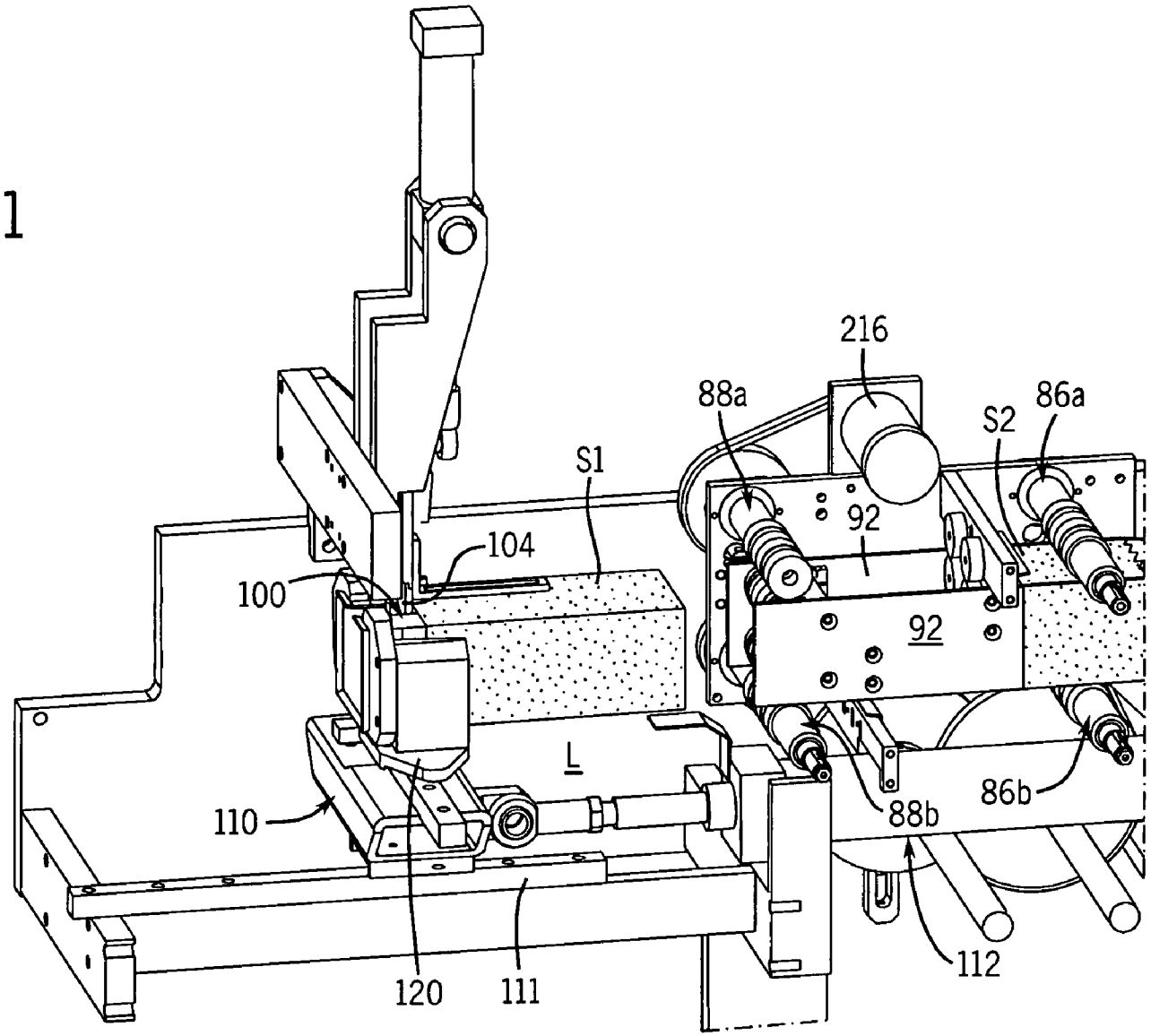
FIG. 21 is a view similar to FIG. 20, showing movement of an article and sleeve stripping arrangement incorporated in the packaging apparatus of FIG. 1 moved to a lowered position and showing initial movement of the article supply arrangement away from the loading area.
Figure 22:
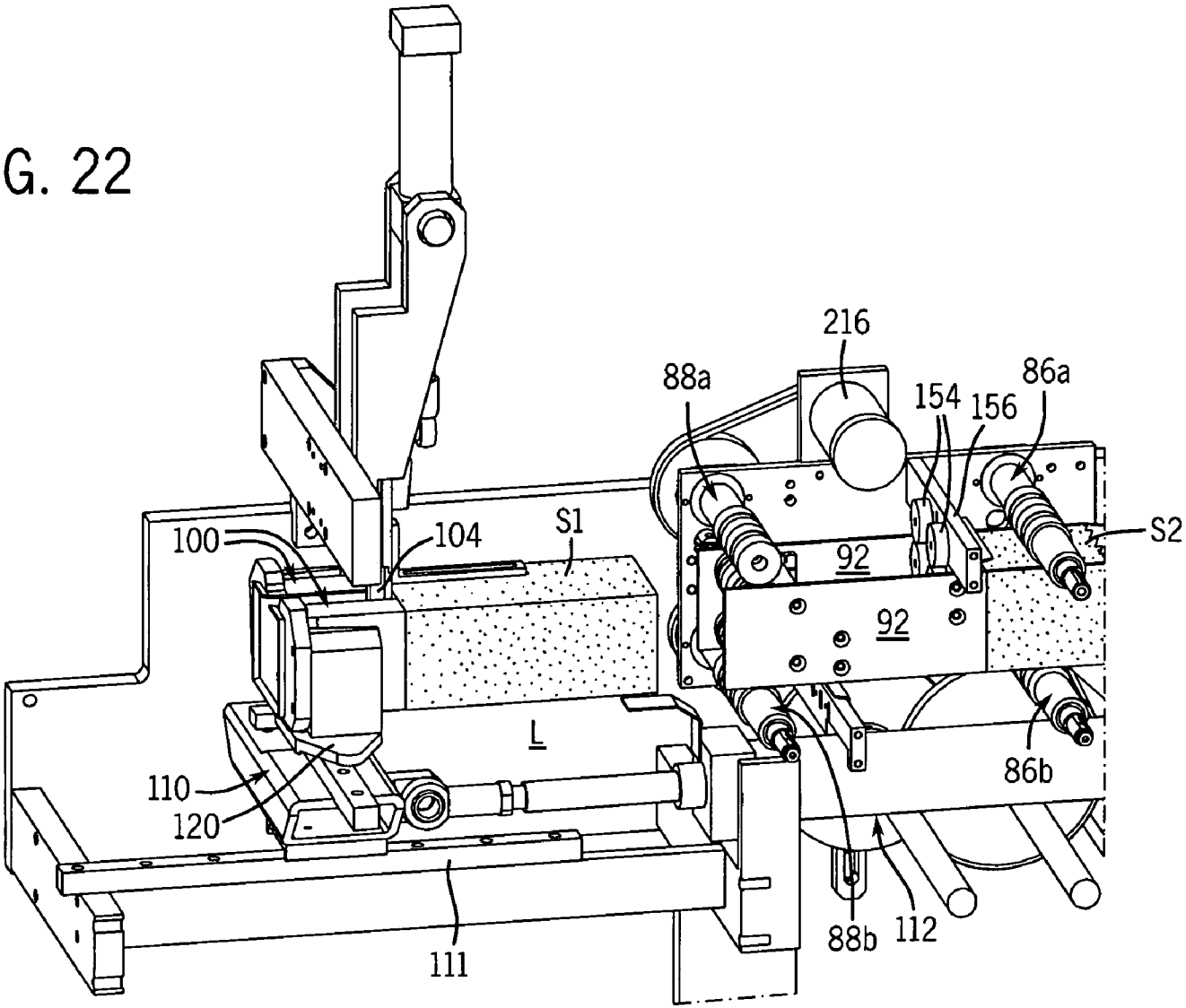
FIG. 22 is a view similar to FIG. 21, showing further movement of the article supply arrangement away from the loading area.
Figure 23:
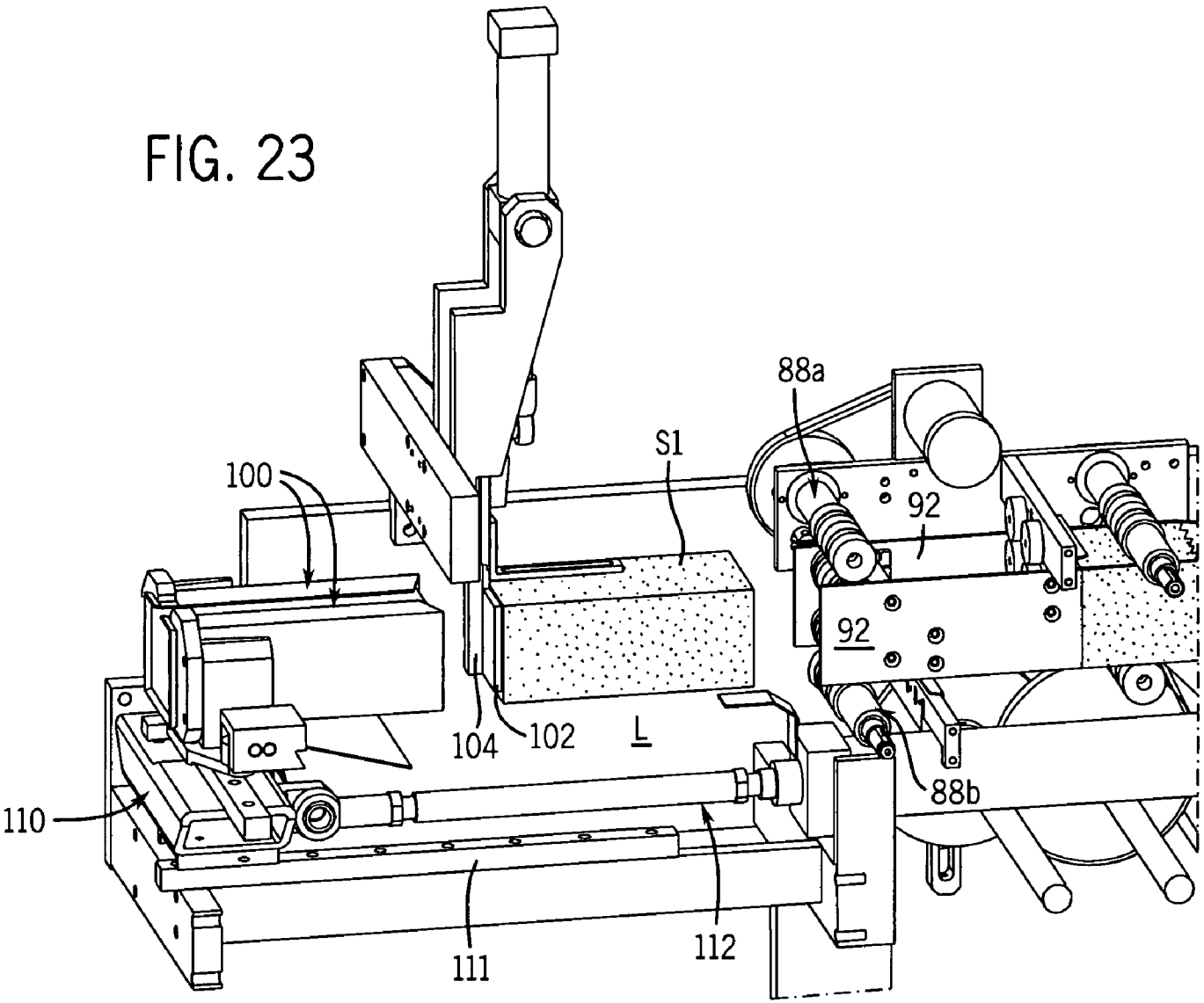
FIG. 23 is a view similar to FIG. 22, showing still further movement of the article supply arrangement away from the loading area.

Downstream of the dancer/festoon assembly 66, tube T travels past a shear cut perforator assembly 74 and is thereafter supplied to a tube erector section 76. Shear cut perforator 74 functions to perforate tube T at predetermined intervals, in a known manner, to form tube perforations 78 (FIG. 18) at predetermined intervals along the length of tube T downstream of shear cut perforator assembly 74.

Tube erector section 76 includes a tube former 80 located downstream of shear cut perforator assembly 74. Tube former 80 is configured to receive the flat tube T formed from the web, and to erect the tube T to create a series of open bands or sleeves S, which are separated by perforations 78. Tube former 80 includes an arcuate spreader bar 82 that is received within the interior of the formed and glued tube T, in combination with a pair of forming wings 84. Spreader bar 82 functions to open tube T downstream of shear cut perforator assembly 74, and to guide tube T onto forming wings 84. Forming wings 84 lie in a vertical plane and have upper and lower edges that diverge in an upstream-to-downstream direction, defining a height at the downstream end that corresponds to the desired height of sleeves S. Forming wings 84 are positioned so as to be convergent in an upstream-to-downstream direction, to accommodate the decrease in width of tube T during formation of the height of tube T on forming wings 84.

Figure 24:
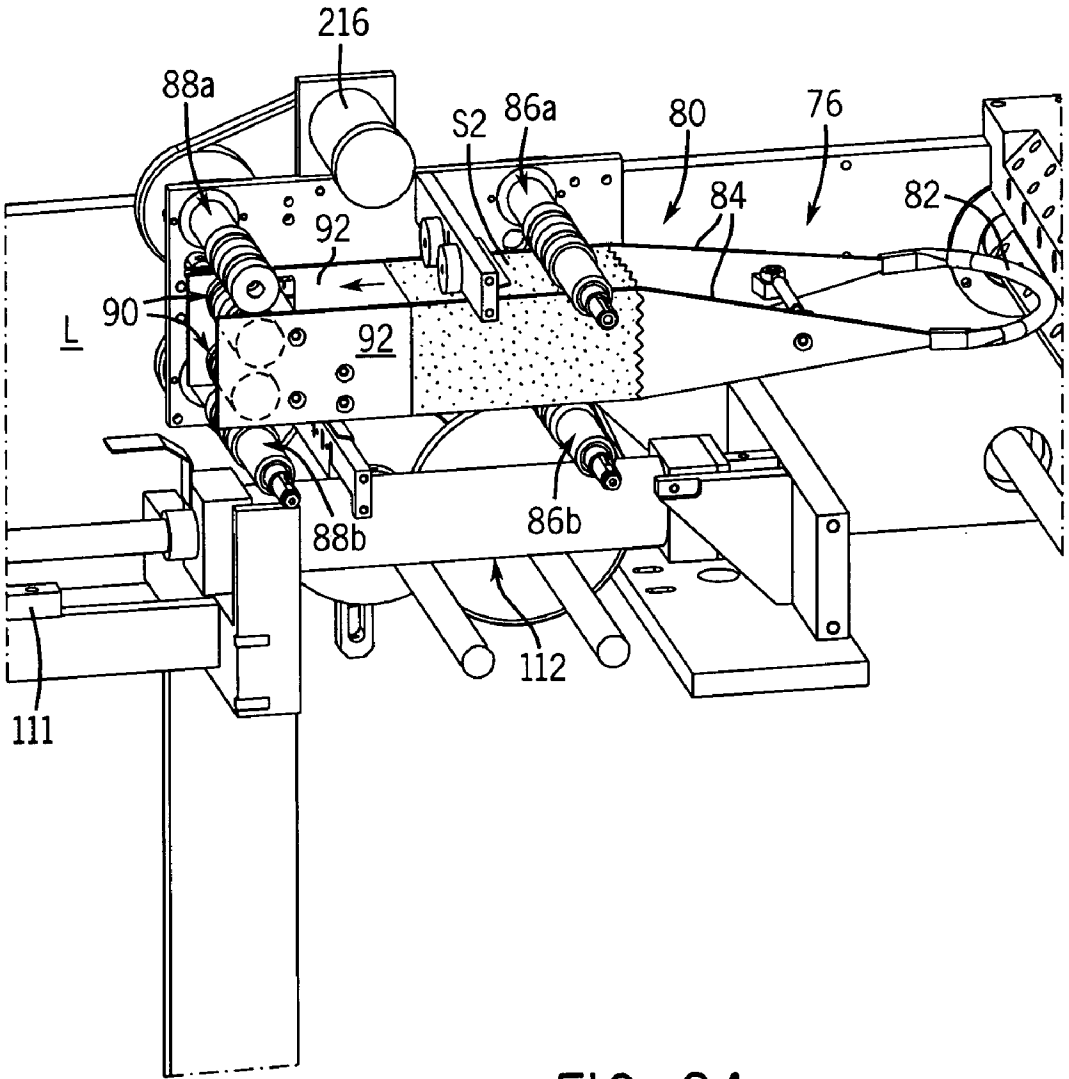
FIG. 24 is a view similar to FIG. 18, showing advancement of a subsequent sleeve on the sleeve supply arrangement.

Downstream of tube former 80, the erected and perforated sleeves S are engaged with sleeve feed rolls 86*a*, 86*b* and with sleeve load rolls 88*a*, 88*b*. A series of idler rolls 90 (FIGS. 10, 24) are located within the interior of sleeves S, and cooperate with feed rolls 86*a*, 86*b* and load rolls 88*a*, 88*b* to advance sleeves S. Idler rolls 90 are rotatably mounted between a pair of rectangular vertical guide walls 92 of sleeve former 80. Each vertical guide wall 92 extends from the downstream end of one of forming wings 84, and defines a downstream end that is located adjacent a loading area L forwardly of sleeve feed rolls 86*a*, 86*b* and sleeve load rolls 88*a*, 88*b*.

Sleeve feed rolls 86*a*, 86*b* and sleeve load rolls 88*a*, 88*b* engage sleeves S so as to advance the formed and perforated sleeves S onto sleeve former 80 downstream of feed/pull rolls 58. In a known manner, tension dancer roll 70 moves upwardly and downwardly in slotted supports 71 as tube T is advanced through the dancer/festoon assembly 66, to maintain a constant tension on tube T and to accommodate the indexing movement of tube T and sleeves S formed from tube T.

As noted above, sleeve feed rolls 86*a*, 86*b* and sleeve load rolls 88*a*, 88*b* advance tube T on tube former 80, so as to form the erected sleeves S. Downstream of forming wings 84, sleeves S are moved onto vertical guide plates 92, which maintain sleeves S in an erected condition adjacent loading area L. In a manner to be explained, the load rolls 88*a*, 88*b* act on sleeves S so as to advance the endmost sleeve S, such as S1, onto an article to be packaged and that is supplied by article supply section 54 to loading area L. During advancement of tube T and sleeves S on tube former 80, sleeve load rolls 88*a*, 88*b* function together with sleeve feed rolls 86*a*, 86*b* to move sleeves S in a downstream direction on tube former 80.

Article supply arrangement 54 includes a pair of movable forks 100 mounted to a carriage 110. Each fork 100 is mounted at its downstream end to a fork mounting plate 103. In a manner to be explained, carriage 110 is selectively movable between an article supply position, in which an article is received between forks 100, and loading area L. A stripping assembly 101 is located downstream of loading area L, and includes a movable strip plate 102 mounted to an arm 104, which is secured to the extendible and retractable rod of a cylinder assembly 106.

The product or article to be packaged is compressible, and is shown throughout the drawings at P. Representatively, the product or article P may be stack of interfolded paper towels. It is understood, however, that the product or article P may be any type of article that can be even slightly compressed and that is suitable for packaging in an open-ended sleeve or band-type arrangement.

FIGS. 4-9 illustrate details of article supply section 54. Generally, article supply section 54 includes the reciprocating carriage 110 as noted above, which is adapted for movement between an article supply position for receiving an article P, and the loading area L at which a sleeve is applied over forks 100 about the article P. Carriage 110 may be reciprocably movable between the article supply position and the loading area L by operation of a pneumatic cylinder assembly 112 (FIG. 3) or in any other satisfactory manner. Carriage 110 is mounted for axial reciprocating movement to a rail 111 mounted to the frame of packaging apparatus 48.

Each fork 100 includes an upper wall 114, a side wall 116, and a serrated bottom wall 118. Each fork 100 is secured within a recess in one of fork mounting plates 103, which has a shape corresponding to that of fork 100. The serrated bottom walls 118 of forks 100 have opposite, complementary serrations, which provide support from below for the article P when the article P is inserted between the forks 110.

One of the forks 100 is stationarily mounted to carriage 110, and the other fork 100 is movable toward and away from the stationary fork 100. In the illustrated embodiment, the mounting plate 103 of the movable fork 100 is mounted to a slide member 120, which is mounted to carriage 110 for transverse movement toward and away from the stationary fork 100. Slide 120 includes a roller or wheel 122. In the illustrated embodiment, the movable fork 100 is moved toward and away from the stationary fork 100 by operation of a stationary pneumatic cylinder assembly 124 having an extendible and retractable rod 126, although it is understood that any other satisfactory mechanism may be employed for moving the movable fork 100 toward and away from the stationary fork 100. A bracket 128 is mounted to the end of rod 126, and includes a downwardly facing recess 130 having a width slightly greater than the diameter of roller 122.

When carriage 110 is in the article supply position and forks 100 are positioned apart, article P is placed between forks 100 so that article P is supported on serrated bottom walls 118 of forks 100. Pneumatic cylinder assembly 124 is then operated so as to extend rod 126, which causes slide member 120 to move laterally on carriage 110 via engagement between roller 122 and bracket 128. Such transverse movement of the movable fork 100 toward the stationary fork 100 results in compression of the article P, as noted previously, by engagement of the fork side walls 116 with the laterally facing surfaces of article P. When the movable fork 100 is moved toward the stationary fork 100 in this manner, the serrations of bottom walls 118 mesh so as to enable the fork bottom walls 118 to move together as forks 100 are moved together to compress article P. Pneumatic cylinder assembly 112 is then operated so as to move carriage 110 axially from the article supply position toward the loading area L.

Figure 7:
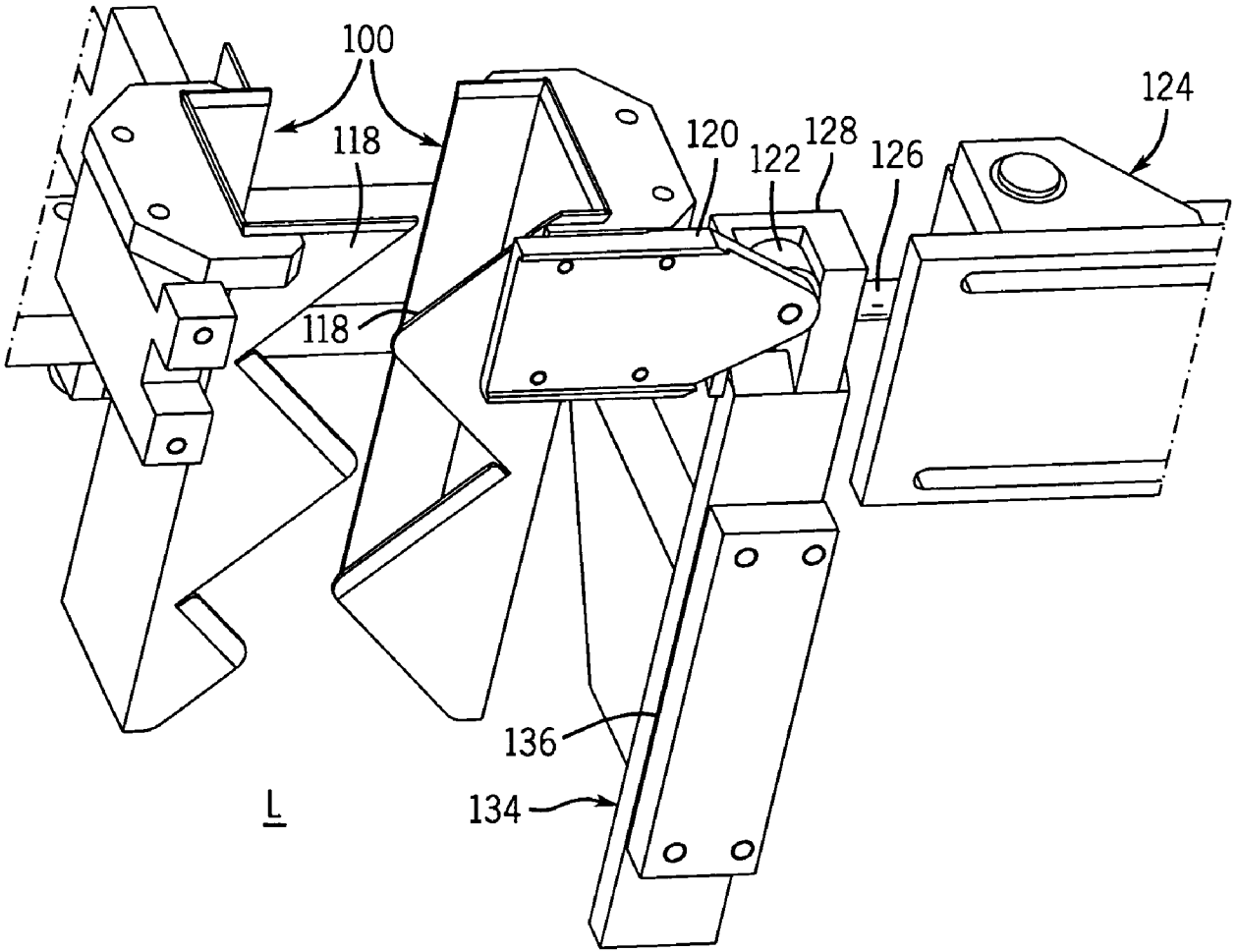
FIG. 7 is a partial bottom isometric view of the article supply arrangement of FIG. 4 in an open position.
Figure 8:
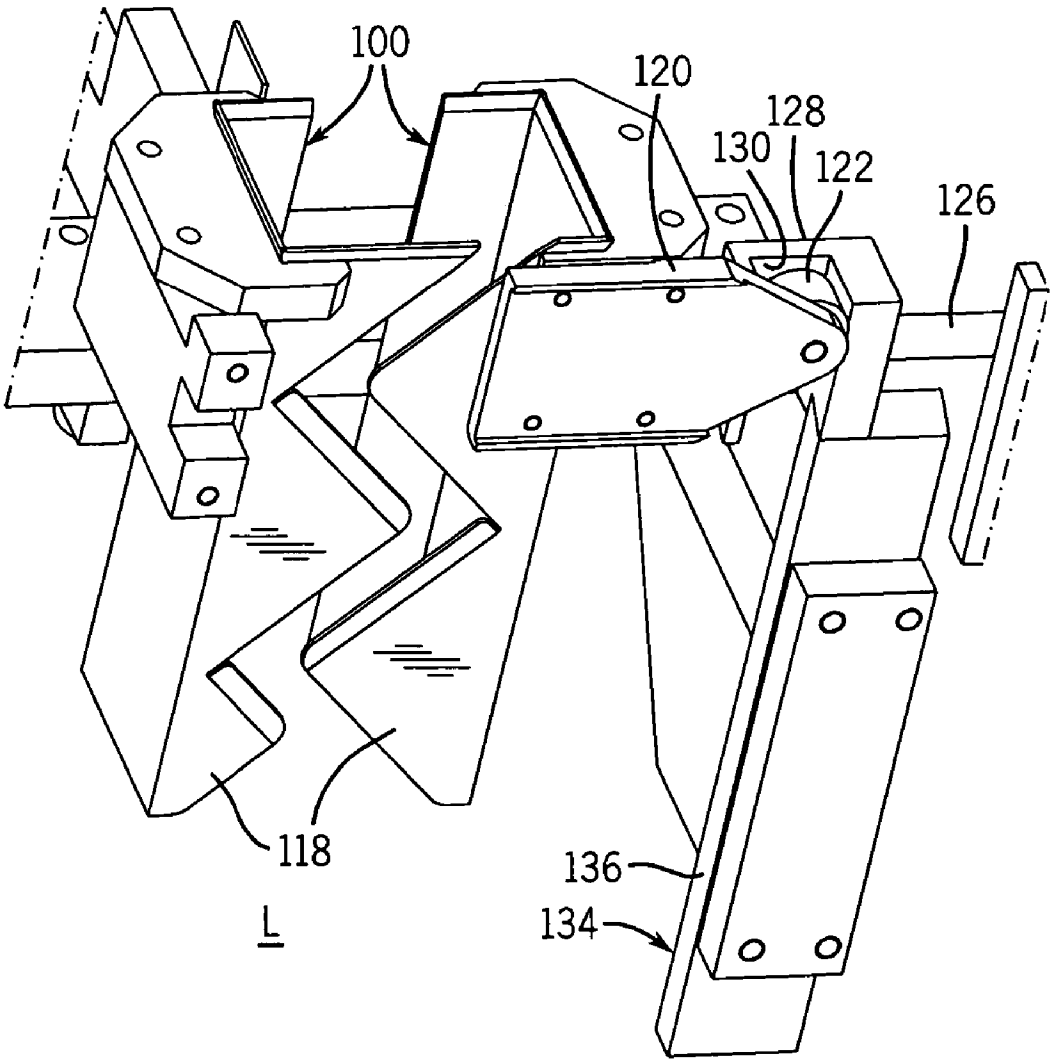
FIG. 8 is a view similar to FIG. 7, showing partial movement of the article supply arrangement toward the closed position.
Figure 9:
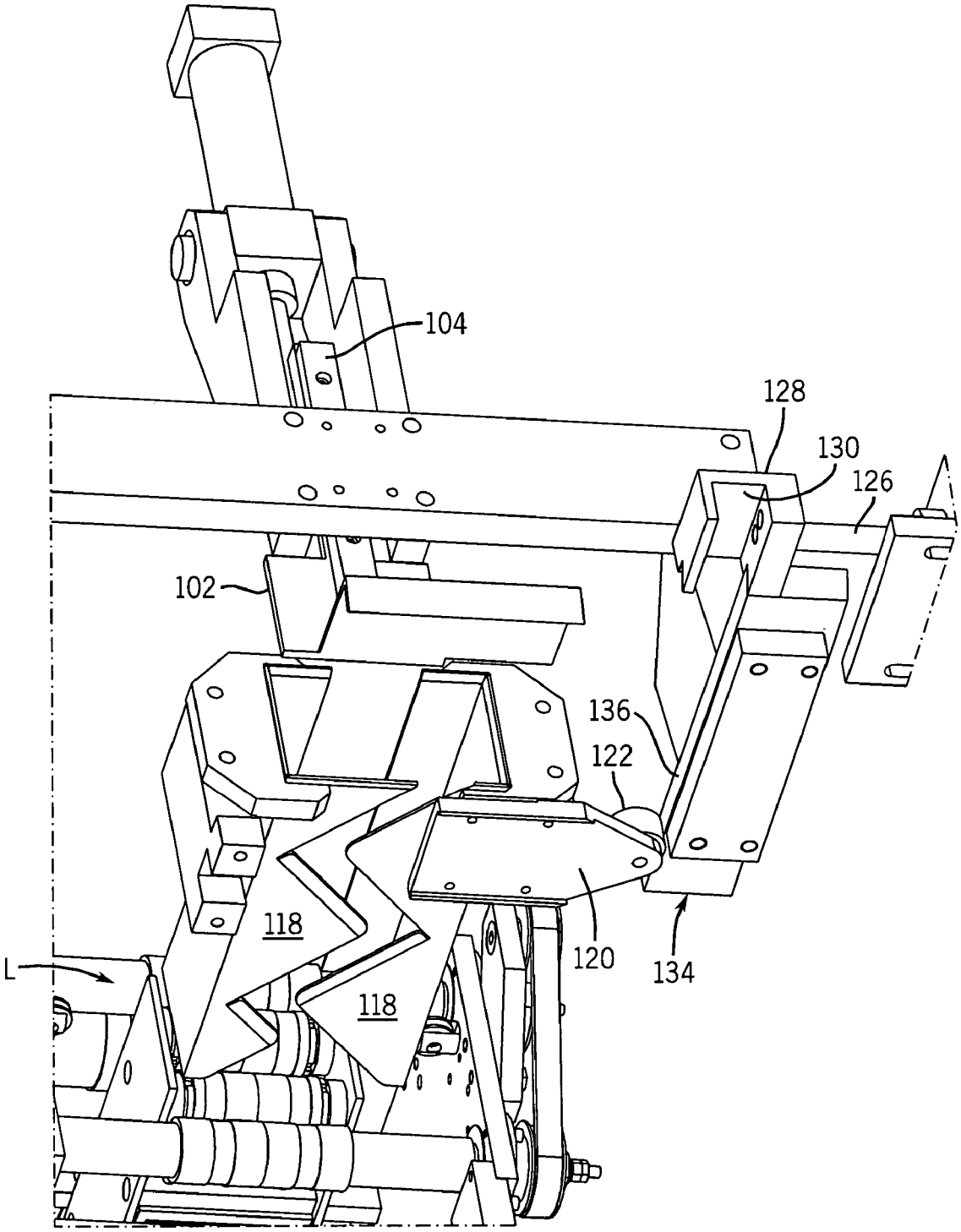
FIG. 9 is a view similar to FIGS. 7 and 8, showing advancement of the article supply arrangement toward a loading area of the packaging apparatus of FIG. 1.

As shown in FIGS. 7-9, an axial guide member 134 is operable to maintain the movable fork 100 in the clamping position as carriage 110 is moved axially between the article supply position and the loading area L. Axial guide member 134 includes an axial guide edge 136, which is parallel to the axial direction of movement of carriage 110 between the article supply position and the loading area L. Guide edge 136 is in vertical alignment with roller 122, and is tangential to roller 122 when pneumatic cylinder assembly 124 is operated so as to move the movable fork 100 to the clamping position, as shown in FIG. 8. When carriage 110 is moved from the article supply position to the loading area L as shown in FIG. 9, roller 122 engages and rolls along guide edge 136. In this manner, the movable fork 100 is maintained in the clamping position during movement of carriage 110 to the loading area L, to maintain compression on article P as the sleeve is advanced over forks 100 about article P. When carriage 110 is returned to the article supply position, roller 122 rolls along guide edge 136 of guide member 134 and returns into recess 130 of bracket 128. In this manner, retraction of pneumatic cylinder assembly 124 functions to subsequently move the movable fork 100 away from the stationary fork 100, in preparation for receiving a subsequent article P therebetween.

FIGS. 10-15 illustrate the detailed construction of sleeve support and loading mechanism 52. A pair of side mounting plates 140 are mounted inwardly of the side members, shown at 142 (FIGS. 1-3) of the frame of packaging apparatus 48. The sleeve feed rolls 86*a*, 86*b* are rotatably mounted between side mounting plates 140 at the upstream end of side mounting plates 140, and guide walls 92 of former 80 are located between sleeve feed rolls 86*a*, 86*b*. Similarly, the sleeve load rolls 88*a*, 88*b* are rotatably mounted between side mounting plates 140 at the downstream end of side mounting plates 140, and guide walls 92 of former 90 are located between sleeve load rolls 88*a*, 88*b*.

Each of rolls 86*a*, 86*b* and 88*a*, 88*b* is formed with a pair of grooves within which a ring-type outer magnet 144 is positioned. Rolls 86*a*, 86*b* and 88*a*, 88*b* further include outer traction rings 146, which may be formed of a high friction material such as rubber. Similarly, the idler rolls 90, which are located between tube former guide plates 92, include inner magnets 148, each of which is in alignment with one of outer magnets 144. Idler rolls 90 further include inner traction rings 150, each of which forms a nip with one of outer traction rings 146.

Outer magnets 144 and inner magnets 148 function to suspend tube former 80 between side mounting plates 140. That is, the magnetic attraction between outer magnets 144 and inner magnets 146 is sufficient to support tube former 80 without any physical connection between tube former 80 and any of the stationary support structure of packaging apparatus 48. In this manner, the formed bands or sleeves S can be advanced onto, and discharged from, tube former 80 without interference of tube former 80 with the band or sleeve walls.

The magnetic attraction between outer magnets 144 and inner magnets 148 suspends tube former 80 between rolls 86*a*, 86*b* and 88*a*, 88*b*, and generally functions to axially locate tube former 80 in the desired axial position between side mounting plates 140. In order to positively position tube former 80 axially, a pair of outer axial positioning magnets 152 are mounted to a transverse support member 154 that extends between side mounting plates 140, and a pair of inner axial positioning magnets 156 are mounted to a transverse support member 158 that extends between vertical guide plates 92 of tube former 80. The magnetic attraction between outer axial positioning magnets 152 and inner axial positioning magnets 154 functions to maintain tube former 80 in a desired axial position between side mounting plates 140. Magnets 152 and 154 are spaced slightly apart from each other, which enables the upper sleeve wall to pass between magnets 152 and 154 when the sleeve is advanced onto vertical guide plates 92.

The frame of packaging apparatus 48 supports a drive motor 162, which supplies rotary power through a right angle gear reducer 164 to drive a belt 166 through a conventional drive pulley. Belt 166 is engaged with a sheave 168 that is mounted to a shaft 170, which is rotatably supported by the frame of packaging apparatus 48. A drive pulley 172 is engaged with the end of shaft 170, and a belt 174 is engaged with drive pulley 172. Belt 174 is engaged with a driven pulley 176 and with a tensioning pulley 178. Driven pulley 176 is secured to the end of a shaft to which a perforating roll 180 of perforating assembly 74 is mounted, so that rotation of driven pulley 176 by movement of belt 174 functions to rotate perforating roll 180 in order to apply perforations 78 to tube T.

An offset upstream drive bar 182 is mounted to the end of shaft 170 opposite sheave 168, and a drive link 184 is mounted to the outer end of offset upstream drive bar 182. The opposite end of drive link 184 is secured to an offset downstream drive bar 186, which is mounted to the end of a shaft 188 that is rotatably supported by the frame of packaging apparatus 48. A drive gear 190 is mounted to shaft 188 inwardly of downstream drive bar 186, and is engaged with a relatively small driven gear 192 mounted to a cross shaft 194 that extends between and is rotatably supported by the frame of packaging apparatus 48. A relatively large input gear 196 is mounted to cross shaft 194 inwardly of driven gear 192, and is rotated along with cross shaft 194 when driven gear 192 is rotated by drive gear 190.

Figure 10:
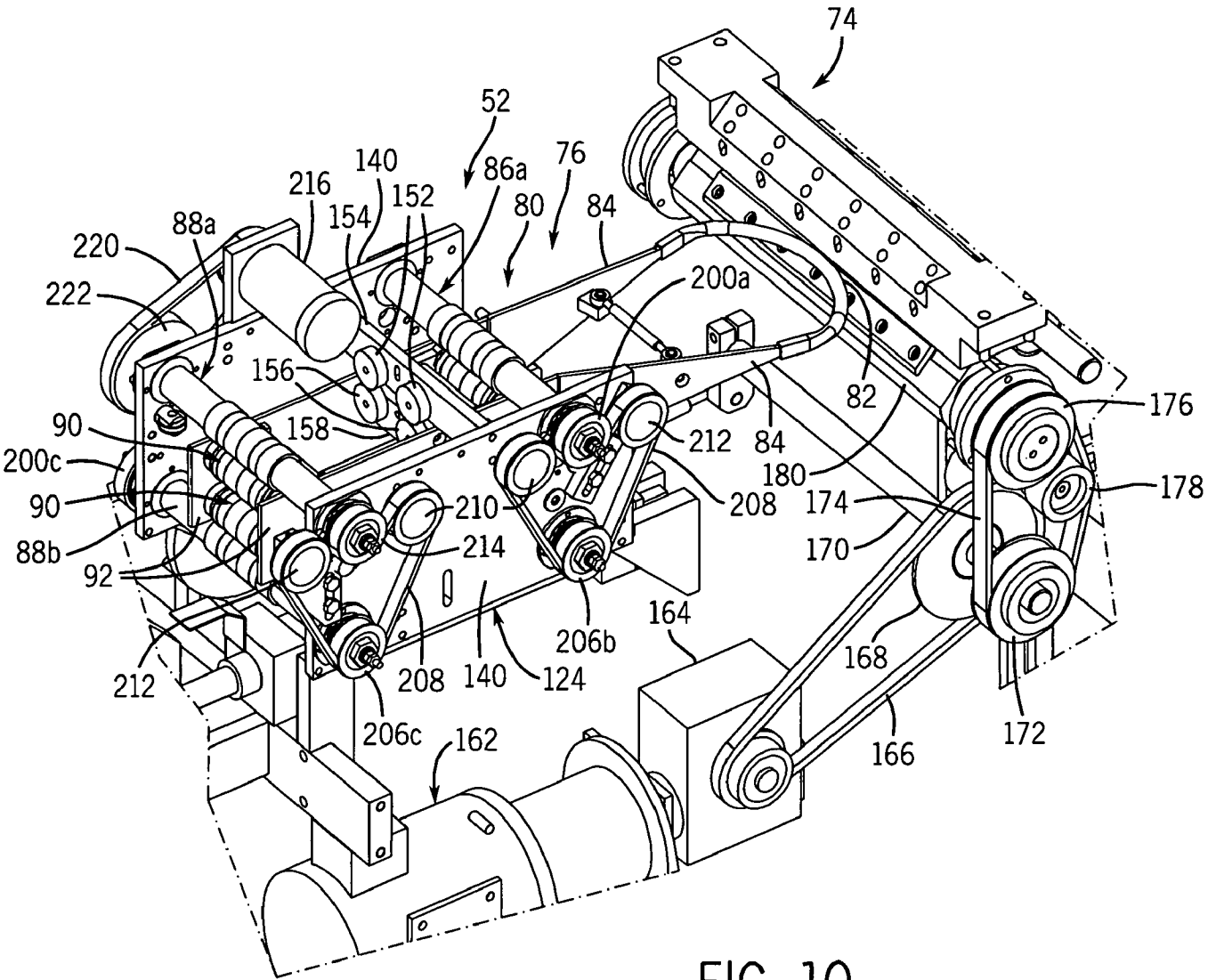
FIG. 10 is a partial isometric view illustrating a sleeve supply arrangement incorporated in the packaging apparatus of FIG. 1.
Figure 11:
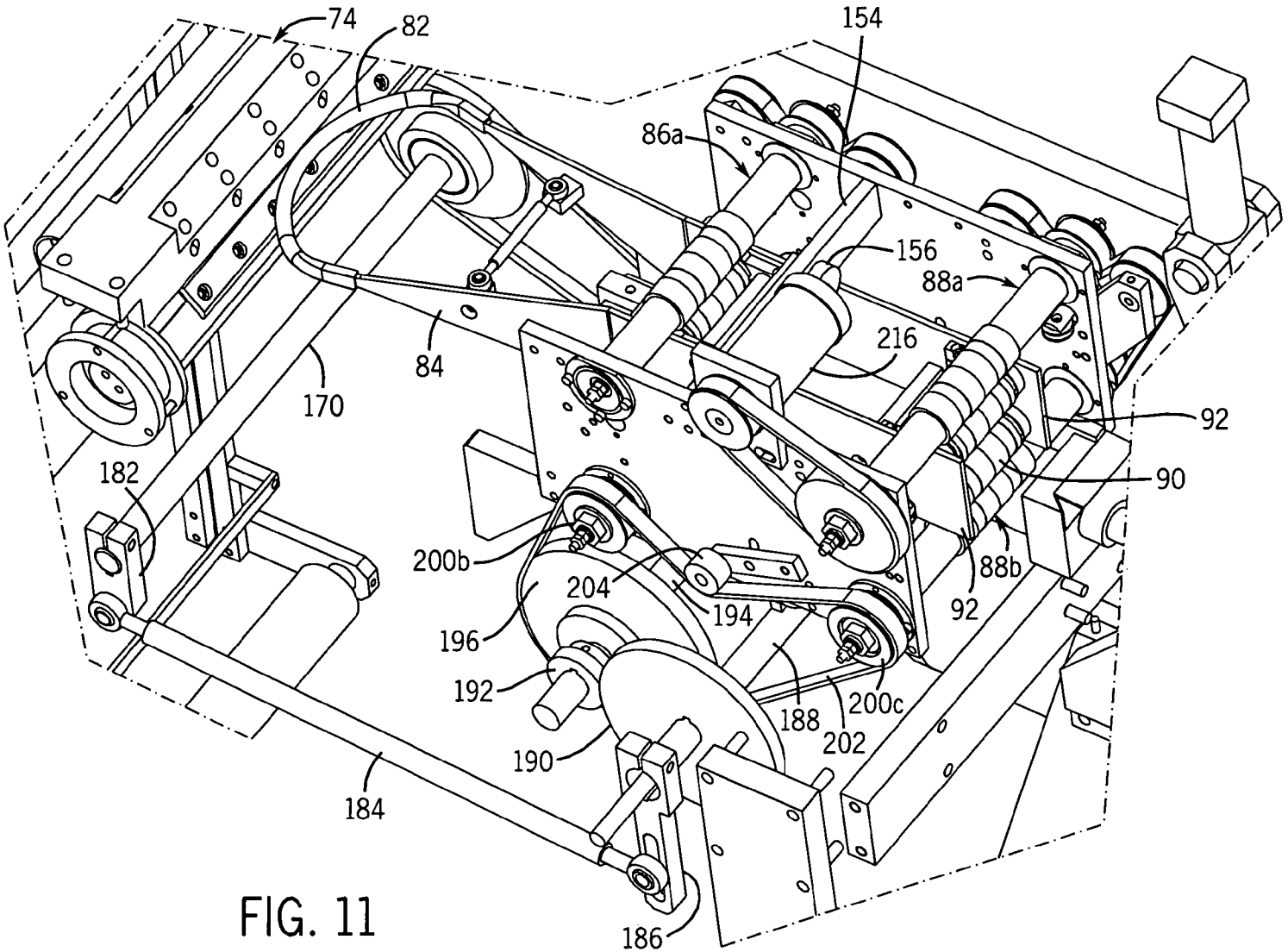
FIG. 11 is a reverse isometric view of the sleeve supply arrangement of FIG. 10.
Figure 12:
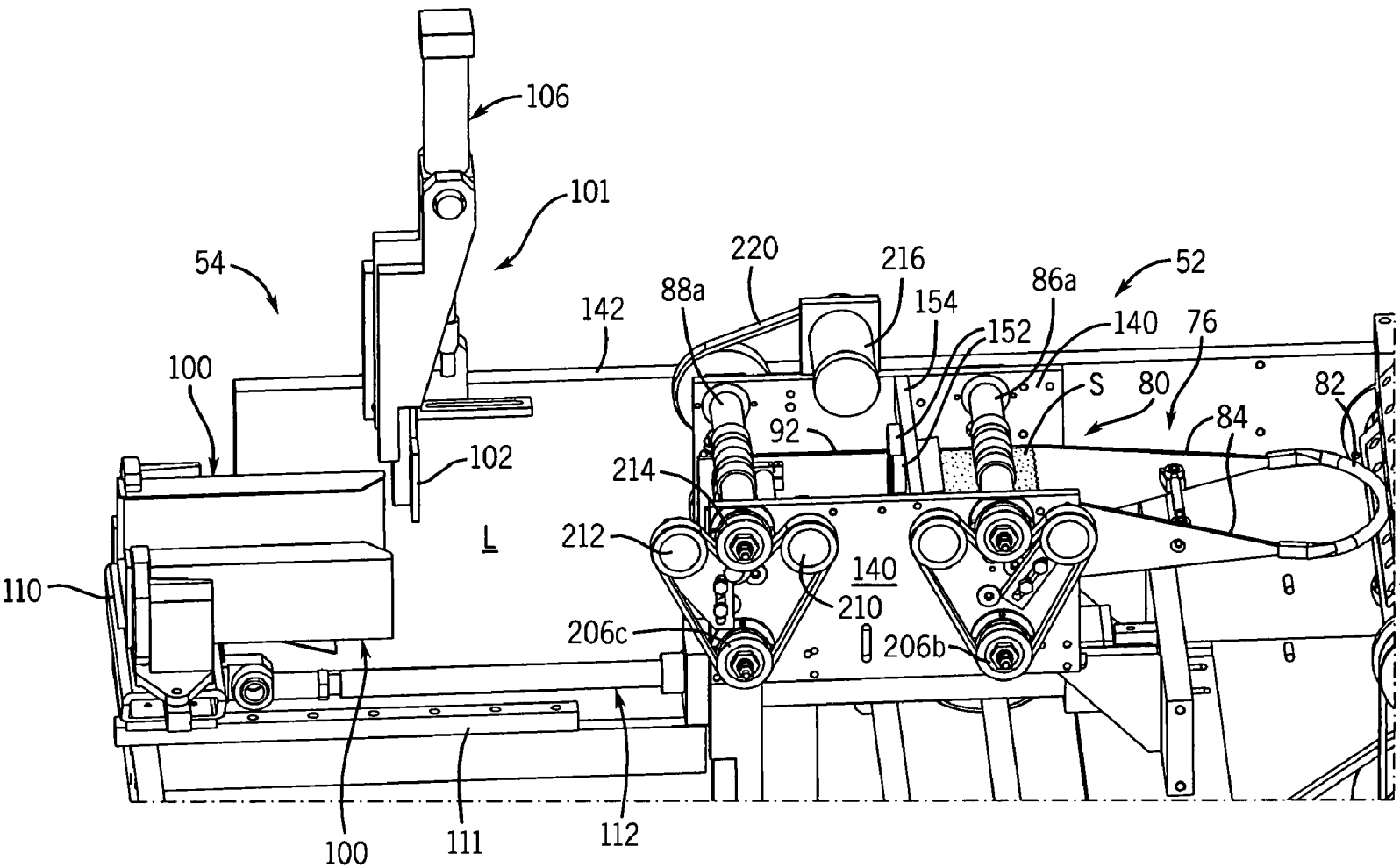
FIG. 12 is a partial isometric view showing the article supply arrangement and the sleeve supply arrangement incorporated in the packaging apparatus of FIG. 1.
Figure 13:
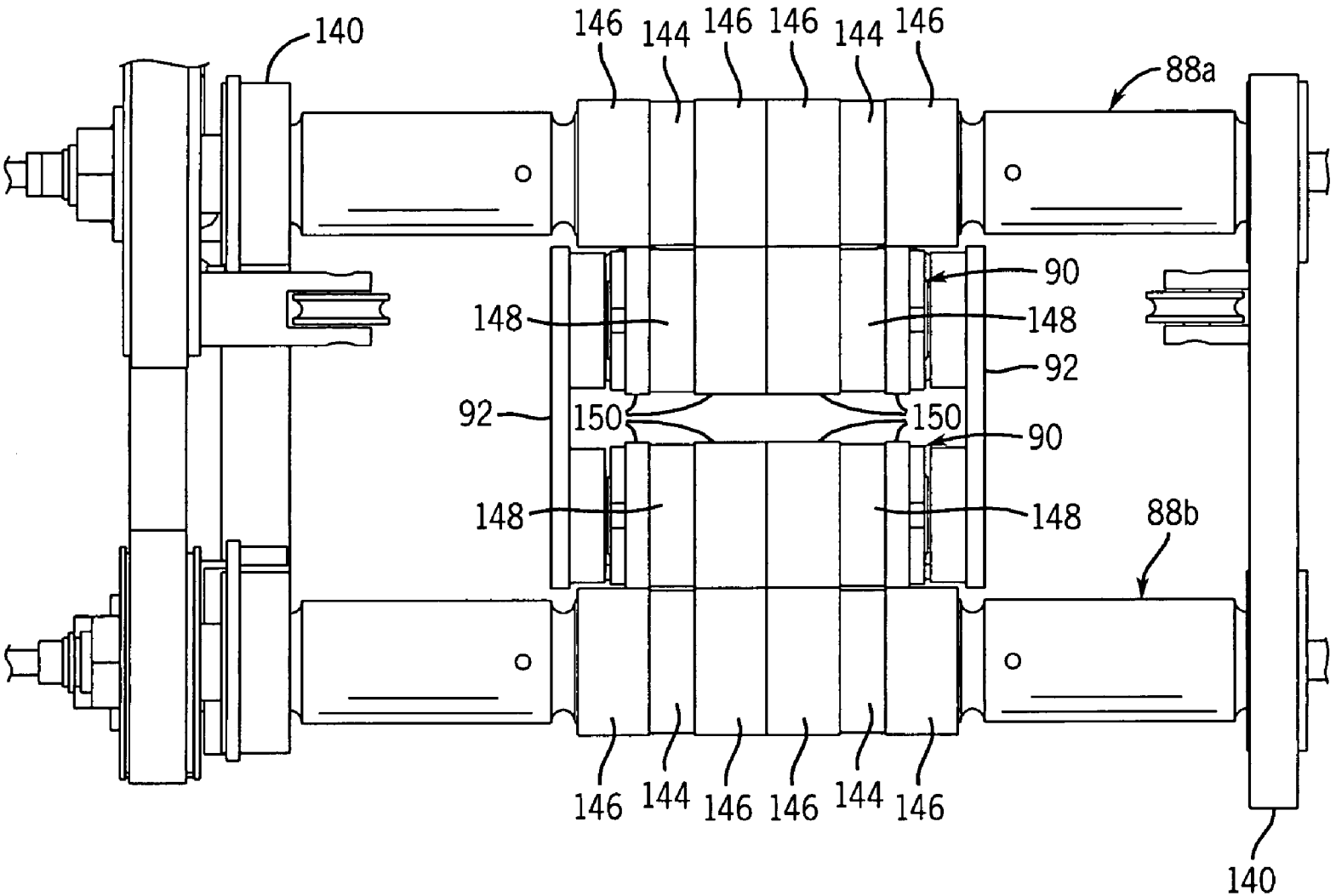
FIG. 13 is an end elevation view of the sleeve supply arrangement of FIG. 12.
Figure 14:
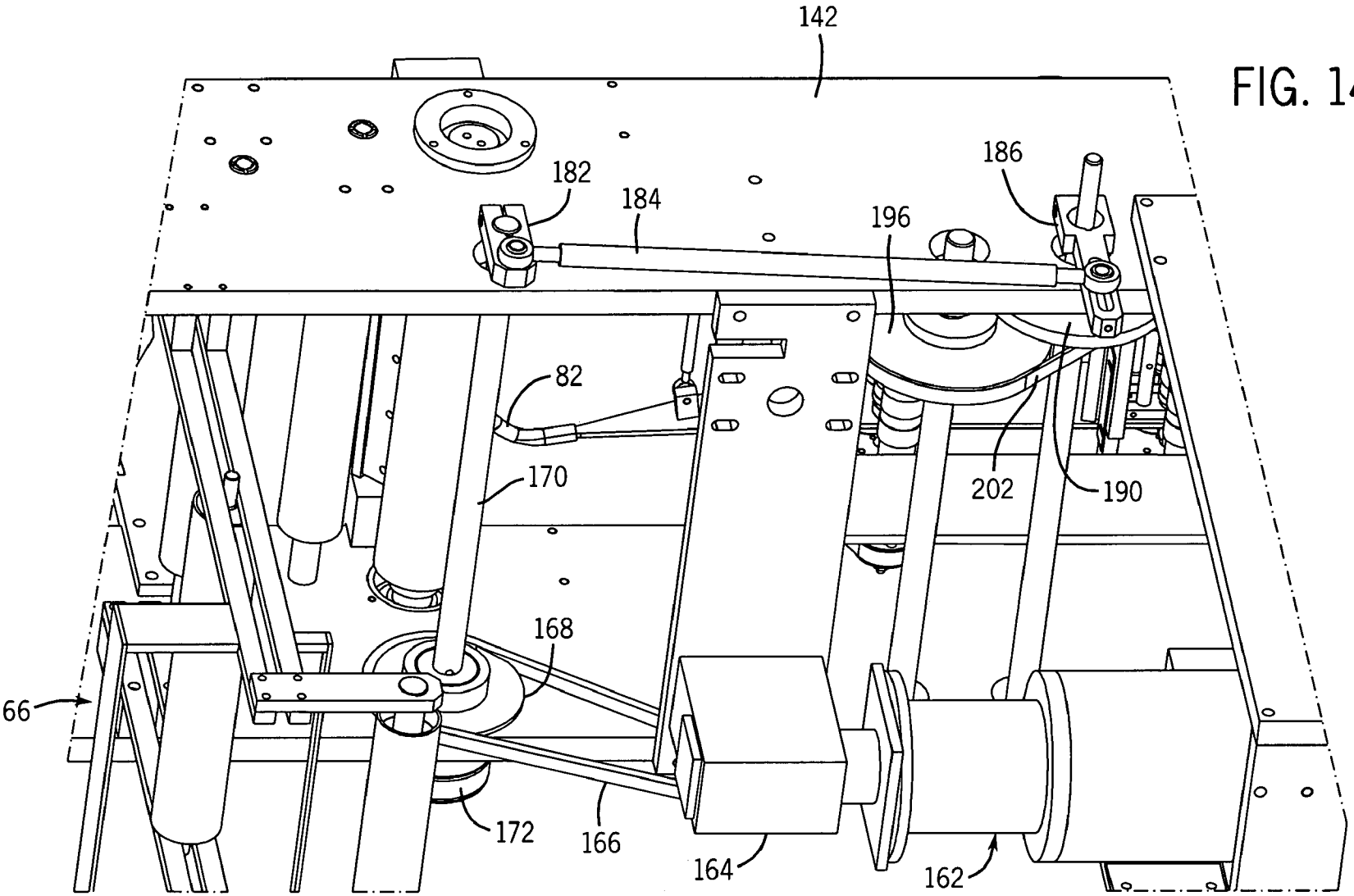
FIG. 14 is a partial bottom isometric view showing the components of a drive system associated with the sleeve supply arrangement of FIG. 12.
Figure 15:
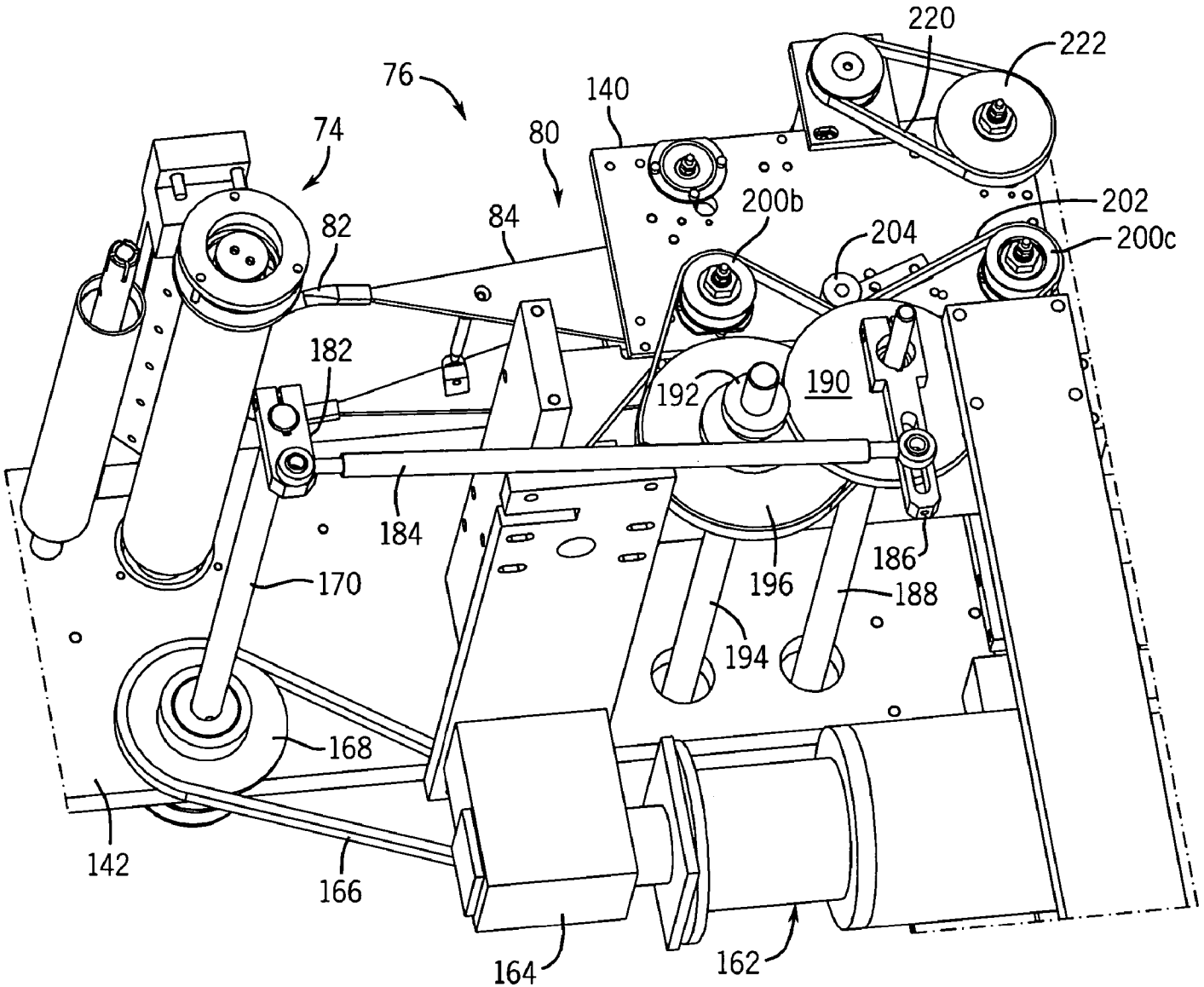
FIG. 15 is a view similar to FIG. 14 showing further details of the drive system of the sleeve supply arrangement.

Input gear 196 is engaged with a pair of drive pulleys 200*b* and 200*c* through a drive belt 202, and a tensioner 204 mounted to one of side mounting plates 140 maintains tension on drive belt 202. Sleeve feed rolls 88*b* and 88*c* are rotatably supported between side mounting plates 140 via a pair of rotatable shafts, and drive pulleys 200*b* and 200*c* are mounted to the ends of the respective shafts to which sleeve feed roll 86*b* and sleeve load roll 88*b* are mounted. In this manner, sleeve feed roll 86*b* and sleeve load roll 88*b* are rotated in response to rotation of respective drive pulleys 220*b* and 200*c*. As shown in FIG. 10, pulleys 206*b* and 206*c* are mounted to the opposite ends of the shafts of sleeve feed roll 86*b* and sleeve load roll 88*b*. Synchronizing drive belts 208 are engaged with pulleys 206*b* and 206*c*, and are trained about idler pulleys 210 that are rotatably mounted to the adjacent side mounting plate 140. Each belt 208 is also engaged with a tensioning pulley 212. At the upstream end of sleeve support and loading mechanism 52, the belt 208 is engaged with a drive pulley 200*a*, which is mounted to the end of the shaft to which sleeve feed roll 88*a* is mounted. At the downstream end of sleeve support and loading mechanism 52, the belt 208 is engaged with a drive pulley 214, which is mounted to the end of the shaft to which sleeve load roll 88*a* is mounted. In this manner sleeve feed roll 86*a* and sleeve load roll 88*a* are rotated synchronously with rotation of sleeve feed roll 86*b* and sleeve load roll 88*b*, respectively, as described above. Such rotation of sleeve feed rolls 86*a*, 86*b* and sleeve load rolls 88*a*, 88*b* functions to advance the sleeve in a downstream direction on sleeve former 80, to a location adjacent the loading area L.

A sleeve load drive motor 216 is supported by one of the side mounting plates 140, and imparts rotation to a drive pulley 218. A belt 220 is engaged with drive pulley 218, and is engaged with a driven pulley 222 that is secured to the end of the shaft that rotatably mounts sleeve load roll 88 between side support plates 140. Sleeve load rolls 88*a*, 88*b* are each mounted to side mounting plates 140 via an overrunning clutch, which selectively enables sleeve load rolls 88*a*, 88*b* to be rotated independently of sleeve feed rolls 86*a*, 86*b*.

In operation, as shown in FIGS. 16-24, the article P is supplied to the area between forks 100 in a lightly compressed state which, in the case of a stack of interfolded paper towels or the like, maintains the stack together. In the illustrated arrangement, the article P is oriented horizontally, although it is understood that the article may be supplied in any orientation. The compressed article P may be loaded into the space between forks 100 in any satisfactory manner. After article P is positioned within the space between forks 100, the article P is compressed by moving forks 100 together to provide a circumference around forks 100 that is less than the circumference of sleeves S. During this sequence, strip plate 102 is positioned out of the path of movement of forks 100 from the article supply position toward loading area L. In the illustrated arrangement, strip plate 102 is raised relative to forks 100, although it is understood that strip plate 102 may be moved in any direction so as to create an unobstructed path between forks 100 and loading area L.

Forks 100 are then moved into loading area L by operation of cylinder assembly 112, so that the ends of forks 100 are located immediately adjacent the downstream ends of the guide plates 92, on which the endmost sleeve S1 is positioned. After article P and forks 100 are moved to the loading area L in this manner, drive motor 216 is operated so as to rotate sleeve load rolls 88*a* and 88*b*. As noted above, sleeve load rolls 88*a* and 88*b* are each mounted via an overrunning clutch, which enables rotation of sleeve load rolls 88*a* and 88*b* while sleeve feed rolls 86*a* and 86*b* remain stationary. Such operation of sleeve load rolls 88*a* and 88*b* causes the endmost sleeve S1 to break away from the next adjacent sleeve, shown at S2, at the perforation 78 between sleeves S1 and S2. Sleeve load rolls 88*a* and 88*b* are operated to feed sleeve S1 onto forks 100, at sufficient speed to ensure that the velocity of sleeve S1 is such that sleeve S1 is propelled completely onto forks 100. When sleeve S1 is advanced onto the forks 100, the end of sleeve S1 comes into contact with the upstream-facing surface of form mounting plates 103, to provide proper positioning of sleeve S1 on forks 100.

Stripper cylinder assembly 106 is then operated to move strip plate 102 into alignment with the path of movement of forks 100. Strip plate 102 has a shape that corresponds to the shape of the end of the compressed article P, and fits within the space defined between forks 100. Strip plate 102 is mounted to an arm 104 that is received within the space defined between forks 100 when forks 100 are moved together. Arm 104 is configured so as to position strip plate 102 into the path of forks 100 when the rod of stripper cylinder assembly 106 is extended, and to move strip plate 102 upwardly out of the path of forks 100 when the rod of stripper cylinder assembly 106 is retracted.

After strip plate 102 is positioned adjacent the end of article P, forks 100 are then moved away from the loading area L toward the article supply position, by operation of cylinder assembly 112. During such movement of forks 100, strip plate 102 remains stationary and engages the end of article P and the end of sleeve S1 in the space between forks 100. In this manner, strip plate 102 functions to strip article P and the applied sleeve S1 out from between forks 100 as forks 100 are moved toward the article supply position. As forks 100 are moved and article P and sleeve S1 remain stationary and are disengaged from between forks 100, the portion of article P that is moved outwardly from between forks 100 decompresses so as to move into engagement with the interior surfaces of sleeve S1. In this manner, a completed package is formed in which sleeve S1 engages the outer periphery of article P, and the friction between sleeve S1 and article P ensures that sleeve S1 remains applied to article P. The completed article package is then allowed to fall by gravity to a collection area or outfeed conveyor located below loading area L.

As the product/sleeve package is stripped off forks 100 by strip plate 102, feed rolls 86*a* and 86*b* are operated along with load rolls 88*a* and 88*b*, to advance the next adjacent sleeve S2 to a downstream position onto guide plates 92 so that sleeve S2 is the endmost sleeve and is ready to be applied to a subsequent article P in the same manner as described previously with respect to sleeve S1. During advancement of sleeve S2 as described previously, shear cut perforator 74 is actuated so as to perforate tube T at the predetermined length to form another upstream sleeve, as described above. Movement of forks 100 of article supply section 54 away from loading area L returns forks 100 to the article supply position so that another article P can be positioned between forks 100 for packaging, using sleeve S2 in the same manner as described previously with respect to sleeve S1.

Various alternatives and embodiments are contemplated as being within the scope of the following claims particularly pointing out and distinctly claiming the subject matter regarded as the invention.

We claim:

1. A method of applying a sleeve to a compressible article having first and second ends, comprising the acts of:

compressing the article between a pair of spaced apart article compression members;

positioning the article compression members in a loading position;

positioning an open-ended sleeve adjacent the article compression members such that the sleeve is aligned with the article compression members, wherein the sleeve defines first and second ends;

advancing the open-ended sleeve onto the article compression members at the loading position such that the article compression members, with the article therebetween, are contained within the sleeve;

positioning a stripper member between the article compression members, wherein the stripper member is in alignment with the first end of the article and with the first end of the sleeve; and releasing compression on the article by engaging the stripper member with the first end of the article and the first end of the sleeve, and moving the article compression members out of the sleeve while engagement of the stripper member with the first end of the article maintains the article within the sleeve, wherein the article expands and engages interior surfaces defined by the sleeve as the article compression members are moved out of the sleeve, to provide a packaged article in which the article is contained within the sleeve.

2. The method of claim 1, wherein the pair of spaced apart article compression members are reciprocably movable between the loading position and an article supply position.

3. The method of claim 1, wherein one of the article compression members is movable toward and away from the other to selectively compress the article.

4. The method of claim 1, including the act of sequentially supplying a series of open-ended sleeves to a location adjacent the loading position.

5. The method of claim 4, wherein the act of sequentially supplying the series of open-ended sleeves to the location adjacent the loading position is carried out by consecutively forming a series of adjacent sleeves from a web of packaging material at a location upstream of the loading position.

6. The method of claim 1, wherein the act of advancing the open-ended sleeve onto the article compression members at the loading position is carried out by advancing the sleeve from a sleeve former located adjacent the loading position, wherein the sleeve former is configured to support the sleeve from within an interior defined by the sleeve.

7. The method of claim 6, including the act of supporting the sleeve former in a manner that enables the sleeve to be axially moved onto the sleeve former.

8. A method of applying a sleeve to a compressible article, comprising the acts of:

compressing the article;

positioning the article in a loading position;

sequentially supplying a series of open-ended sleeves to a location adjacent the loading position by consecutively forming a series of adjacent sleeves from a web of packaging material at a location upstream of the loading position;

advancing an open-ended sleeve onto the article at the loading position; and releasing compression on the article so that the article expands and engages interior surfaces defined by the sleeve, to provide a packaged article in which the article is contained within the sleeve;

wherein the act of consecutively forming the series of adjacent sleeves from the web of packaging material is carried out by bonding overlapping edge areas of the web together to form a collapsed tube, forming transverse perforations in the collapsed tube at locations corresponding to the length of a sleeve, advancing the collapsed tube toward a forming area located adjacent the loading position, and forming the collapsed tube at the forming area to an erected condition upstream of the loading position.

9. The method of claim 8, wherein the act of advancing the sleeve onto the article at the loading position is carried out by separating an endmost one of the sleeves located at the forming area from the next adjacent sleeve at the transverse perforations.

10. A method of applying an open-ended sleeve to a compressible article, comprising the acts of:

compressing the article;

positioning the article in a loading position by advancing the sleeve from a sleeve former located adjacent the loading position, wherein the sleeve former is configured to support the sleeve from within an interior defined by the sleeve;

supporting the sleeve former in a manner that enables the sleeve to be axially moved onto the sleeve former, wherein the act of supporting the sleeve former is carried out by magnetically supporting the sleeve former;

advancing the sleeve from the sleeve former onto the article at the loading position; and releasing compression on the article so that the article expands and engages interior surfaces defined by the sleeve, to provide a packaged article in which the article is contained within the sleeve.

11. The method of claim 10, wherein the act of advancing the sleeve onto the article is carried out using a roller arrangement including one or more outer drive rollers and one or more inner rollers, each of which cooperates with one of the outer drive rollers.

12. The method of claim 10, wherein the act of magnetically supporting the sleeve former is carried out by one or more inner magnets on the one or more inner rollers and one or more outer magnets on the one or more outer drive rollers, wherein the inner and outer magnets cooperate to magnetically support the sleeve former to enable the sleeve to be axially moved onto the sleeve former.

13. A packaging system for a compressible article having first and second ends, comprising:

article compression means for compressing the article and for positioning the article in a loading area, wherein the article compression means comprises a pair of spaced apart article compression members;

sleeve advancing means for positioning an open-ended sleeve adjacent the article compression members such that the sleeve is aligned with the article compression members, wherein the sleeve defines first and second ends, and for advancing the open-ended sleeve onto the article compression members at the loading area while the article is maintained stationary at the loading area, wherein the article compression members, with the article therebetween, are contained within the sleeve;

stripper means for placement between the article compression members, wherein the stripper means is in alignment with the first end of the article and with the first end of the sleeve; and discharge means for discharging the article and the sleeve from the article compression means, wherein the discharge means is configured to move the article compression members out of the sleeve while engagement of the stripper means with the first end of the article and the first end of the sleeve maintains the article within the sleeve, wherein the article expands and engages interior surfaces defined by the sleeve as the article compression members are moved out of the sleeve, to provide a packaged article in which the article is contained within the sleeve.

14. The packaging system of claim 13, further comprising sleeve forming means for sequentially forming individual sleeves from a web of packaging material, wherein the first end of each sleeve is located adjacent the loading area.

15. The packaging system of claim 14, wherein the sleeve forming means is operable to consecutively form a series of adjacent sleeves from the web of packaging material by bonding overlapping edge areas of the web together to form a collapsed tube.

16. The packaging system of claim 15, wherein the sleeve forming means is further operable to advance the collapsed tube toward a forming area located adjacent the loading area, and to form the collapsed tube at the forming area to an erected condition upstream of the loading area.

17. The packaging system of claim 16, further comprising perforating means for forming transverse perforations in the collapsed tube at locations corresponding to the length of a sleeve, wherein the endmost sleeve is separated from the next adjacent sleeve by a perforation, and wherein the advancing means functions to advance the endmost sleeve onto the article at the loading area by breaking the endmost sleeve away from the next adjacent sleeve at the perforation.

18. The packaging system of claim 13, wherein the article compression members are mounted to movable carriage means for selectively positioning the article compression members in the loading area.

19. The packaging system of claim 13, wherein the sleeve is supported by sleeve support means adjacent the loading area, and wherein the sleeve advancing means cooperates with the sleeve support means for advancing the sleeve onto the article at the loading area.

20. A packaging system for a compressible article, comprising:

article compression means for compressing the article and for positioning the article in a loading area;

sleeve advancing means for advancing an open-ended sleeve onto the article at the loading area while the article is maintained stationary at the loading area;

sleeve support means for supporting the sleeve adjacent the loading area, wherein the sleeve advancing means cooperates with the sleeve support means for advancing the sleeve onto the article at the loading area, wherein the sleeve support means includes magnetic support means for supporting the sleeve support means in a manner that enables the sleeve to be advanced onto the sleeve support means and off the sleeve support means onto the article at the loading area; and discharge means for discharging the article and the sleeve from the article compression means, wherein the article expands and engages interior surfaces defined by the sleeve, to provide a packaged article in which the article is contained within the sleeve.

21. The packaging system of claim 20, wherein the sleeve advancing means comprises one or more outer roller means for engaging the sleeve and advancing the sleeve from the sleeve support means toward the loading area, and wherein the sleeve support means includes one or more inner roller means for cooperating with the outer roller means to advance the sleeve, and wherein the magnetic support means is carried by the outer and inner roller means.

22. The packaging system of claim 20, wherein the magnetic support means includes magnetic axial positioning means for maintaining the sleeve support means in position adjacent the loading area.

* * * * *